US010293210B2

(12) United States Patent
Wei et al.

(10) Patent No.: US 10,293,210 B2
(45) Date of Patent: May 21, 2019

(54) TREADMILL AND CONTROL METHOD FOR CONTROLLING THE TREADMILL BELT THEREOF

(71) Applicant: PIXART IMAGING INC., Hsin-Chu (TW)

(72) Inventors: Wei-Feng Wei, Hsin-Chu (TW); Chao-Chien Huang, Hsin-Chu (TW); Chi-Yang Huang, Hsin-Chu (TW); Jung-Tai Lin, Hsin-Chu (TW)

(73) Assignee: PIXART IMAGING INC., Hsin-Chu (TW)

( * ) Notice: Subject to any disclaimer, the term of this patent is extended or adjusted under 35 U.S.C. 154(b) by 140 days.

(21) Appl. No.: 15/418,621

(22) Filed: Jan. 27, 2017

(65) Prior Publication Data

US 2017/0225038 A1 Aug. 10, 2017

(30) Foreign Application Priority Data

Feb. 4, 2016 (TW) ..... 105103737 A
Jan. 12, 2017 (CN) ..... 2017 1 0022557

(51) Int. Cl.
*A63B 22/02* (2006.01)
*A63B 24/00* (2006.01)

(52) U.S. Cl.
CPC ..... *A63B 24/0087* (2013.01); *A63B 22/02* (2013.01); *A63B 22/025* (2015.10); *A63B 22/0235* (2013.01); *A63B 22/0242* (2013.01); *A63B 2024/0093* (2013.01); *A63B 2220/805* (2013.01)

(58) Field of Classification Search
CPC . A63B 24/0087; A63B 22/02; A63B 22/0235; A63B 22/025; A63B 2024/0093; A63B 22/0242; A63B 2220/805
See application file for complete search history.

(56) References Cited

U.S. PATENT DOCUMENTS 5,314,391 A * 5/1994 Potash ..... A63B 22/0023 340/573.1
5,368,532 A * 11/1994 Farnet ..... A63B 22/02 482/5
5,800,314 A * 9/1998 Sakakibara ..... A63B 22/02 482/1
6,135,924 A * 10/2000 Gibbs ..... A63B 22/02 482/51
6,626,803 B1 * 9/2003 Oglesby ..... A63B 22/02 482/51

(Continued)

FOREIGN PATENT DOCUMENTS

CN 105251175 A 1/2016
CN 105288941 A 2/2016

(Continued)

*Primary Examiner* — Sundhara M Ganesan
(74) *Attorney, Agent, or Firm* — Li & Cai Intellectual Property (USA) Office

(57) ABSTRACT

A treadmill and a control method for controlling the treadmill belt thereof are provided. The treadmill includes a treadmill belt, a first sensor, an image sensor, and a controller. The first sensor retrieves a light pattern or the image sensor measures the characteristic properties of the image of the user so as to control the treadmill belt. The light pattern can be generated by a signal member, which can be disposed on a side or both sides of the treadmill belt.

6 Claims, 27 Drawing Sheets

(56) References Cited

U.S. PATENT DOCUMENTS

| | | | | |
|---|---|---|---|---|
| 6,733,423 | B1 * | 5/2004 | Chang | A63B 22/02 482/51 |
| 2002/0130951 | A1 | 9/2002 | Kurono | |
| 2004/0072656 | A1 | 4/2004 | Wang et al. | |
| 2006/0063644 | A1 * | 3/2006 | Yang | A63B 24/00 482/4 |
| 2006/0084552 | A1 * | 4/2006 | Huang | A63B 22/02 482/9 |
| 2010/0261579 | A1 | 10/2010 | Rice | |
| 2012/0127317 | A1 | 5/2012 | Yantek et al. | |
| 2012/0184409 | A1 * | 7/2012 | Beal | A63B 69/0048 482/5 |
| 2014/0113770 | A1 * | 4/2014 | Yim | A63B 24/0062 482/8 |
| 2014/0256511 | A1 * | 9/2014 | Smith | G10H 7/00 482/8 |
| 2016/0007885 | A1 | 1/2016 | Basta et al. | |
| 2017/0209734 | A1 | 7/2017 | Huang | |

FOREIGN PATENT DOCUMENTS

| | | | |
|---|---|---|---|
| JP | 11-258973 | A | 9/1999 |
| TW | I587892 | B | 6/2017 |

* cited by examiner

| gesture | command |
|---|---|
| holding both hands up | starts the operation |
| waving hands | stop the operation |
| rotating hands clockwise | Increase the operating speed |
| rotating hands counterclockwise | Decrease the operating speed |
| moving hands up | Increase the slope of the treadmill |
| moving hands down | Decrease the slope of the treadmill |

TREADMILL AND CONTROL METHOD FOR CONTROLLING THE TREADMILL BELT THEREOF

BACKGROUND OF THE INVENTION

1. Field of the Invention

The present disclosure relates to a treadmill and a control method for controlling the treadmill belt thereof; more particularly, to a treadmill and a control method for controlling the treadmill belt thereof in which an image sensor is utilized to measure specific light patterns or to determine the characteristics of the images of a user so as to adjust the treadmill belt accordingly.

2. Description of Related Art

Fitness has become an important issue for people all around the world, motivating more and more people to build an exercise habit. The treadmill is one of the most common exercise machines at present. A treadmill of the prior art provides functionalities such as speed adjustment, a timer, and various exercise modes so that users can adjust their exercise routine on the treadmill as needed.

In the prior art, when a user wishes to adjust the speed of the treadmill belt, manual operation of the control panel on the treadmill is required. However, since the user's physical strength will gradually decrease as the exercise continues, accidents may happen when the user tries but fails to reach the control panel from the farther end of the treadmill belt due to fatigue.

Furthermore, everyone has their own natural way of running. For example, some treadmill users habitually run towards a lateral side of the treadmill belt, which applies uneven pressure to the treadmill and hence is likely to shorten the lifespan of the treadmill after long-term use.

Therefore, one of the primary objectives in the art is to overcome the afore-mentioned shortcomings and provide a durable and safe treadmill.

SUMMARY OF THE INVENTION

Accordingly, the present disclosure provides a treadmill that includes a treadmill belt, a first signal member, a first sensor, and a controller. The first signal member is disposed at position near a first side of the treadmill belt. The first sensor retrieves a first image. The first image includes a first light pattern provided by the first signal member, and the first light pattern extends from a first starting point of the first image. The controller is coupled to the first sensor and adjusts an operating speed of the treadmill belt in accordance with a characteristic property of the first light pattern.

Another embodiment of the present disclosure provides a control method for controlling the treadmill belt of a treadmill, in which the treadmill includes a treadmill belt. A first signal member is disposed at a position near a first side of the treadmill belt. The control method includes a step A: retrieving a first image using a first sensor, wherein the first image includes a first light pattern provided by the first signal member, the first light pattern extending from a first starting point of the first image; a step B: controlling an operating speed of the treadmill belt according to a length of the first light pattern using a controller.

According to another embodiment of the present disclosure, a treadmill is disclosed, in which the treadmill includes a treadmill belt, an image sensor, and a controller. The image sensor includes an image sensing unit for retrieving an image of a user. The controller is electrically connected to the image sensor and adjusts an operating speed of the treadmill belt according to the percentage of the pixels representing the user in all the pixels of the image.

Another embodiment of the present disclosure provides a control method for controlling the treadmill belt of a treadmill, in which the treadmill includes a treadmill belt, an image sensor, and a controller. The control method includes: an image sensing unit of the image sensor retrieving an image of a user, and the controller adjusting an operating speed according to the percentage of the pixels representing the user in all the pixels of the image.

Another embodiment of the present disclosure provides a treadmill including a treadmill belt, an image sensor including an image sensing unit for retrieving an image of a user, and a controller electrically connected to the image sensor, in which the controller performs at least one of a startup operation, a shutdown operation, a speed-up operation, and a slow-down operation according to at least one gesture image corresponding to at least one gesture made by the user.

The treadmill and the control method for controlling the treadmill belt thereof provided by the present disclosure can accelerate or decelerate the operating speed or stop the operation of the treadmill belt according to the physical condition and the running rate of the treadmill user according to the position of the treadmill user, preventing accidents that may occur when the user is too exhausted to keep up with the speed of the treadmill. Furthermore, the treadmill of the present disclosure can adjust the slope of the running surface such that the user can stay running in the middle of the treadmill belt, improving the user's running posture and reducing uneven pressure distribution applied to the treadmill. Moreover, the treadmill of the present disclosure can adjust the operating speed of the treadmill belt in accordance with the percentage of the pixels representing the user in the image retrieved by the image sensor, and can perform various operations in accordance with gestures made by the user shown in the image retrieved by the image sensor. Through the above technical means, the treadmill of the present disclosure performs operations and adjusts the treadmill belt automatically so that the treadmill users do not need to manually operate the treadmill.

In order to further the understanding of the present disclosure, the following embodiments are provided along with illustrations to facilitate the disclosure of the present disclosure.

DETAILED DESCRIPTION OF THE PREFERRED EMBODIMENTS

The aforementioned illustrations and following detailed description are exemplary for the purpose of further explaining the scope of the present disclosure. Other objectives and advantages related to the present disclosure will be illustrated in the following description and appended drawings.

It should be understood that, although terms such as "first" and "second" are used to describe the components of the present disclosure in the description below, the components are not limited by these terms. Instead, the use of these terms is merely for the purpose of distinguishing components from each other. On the other hands, the term "or" may indicate that any one of the listed items or all the possible combinations thereof are included.

The present disclosure adjusts the operating speed of the treadmill belt of a treadmill by retrieving and measuring light patterns or the images of the treadmill users.

Figure 1A:
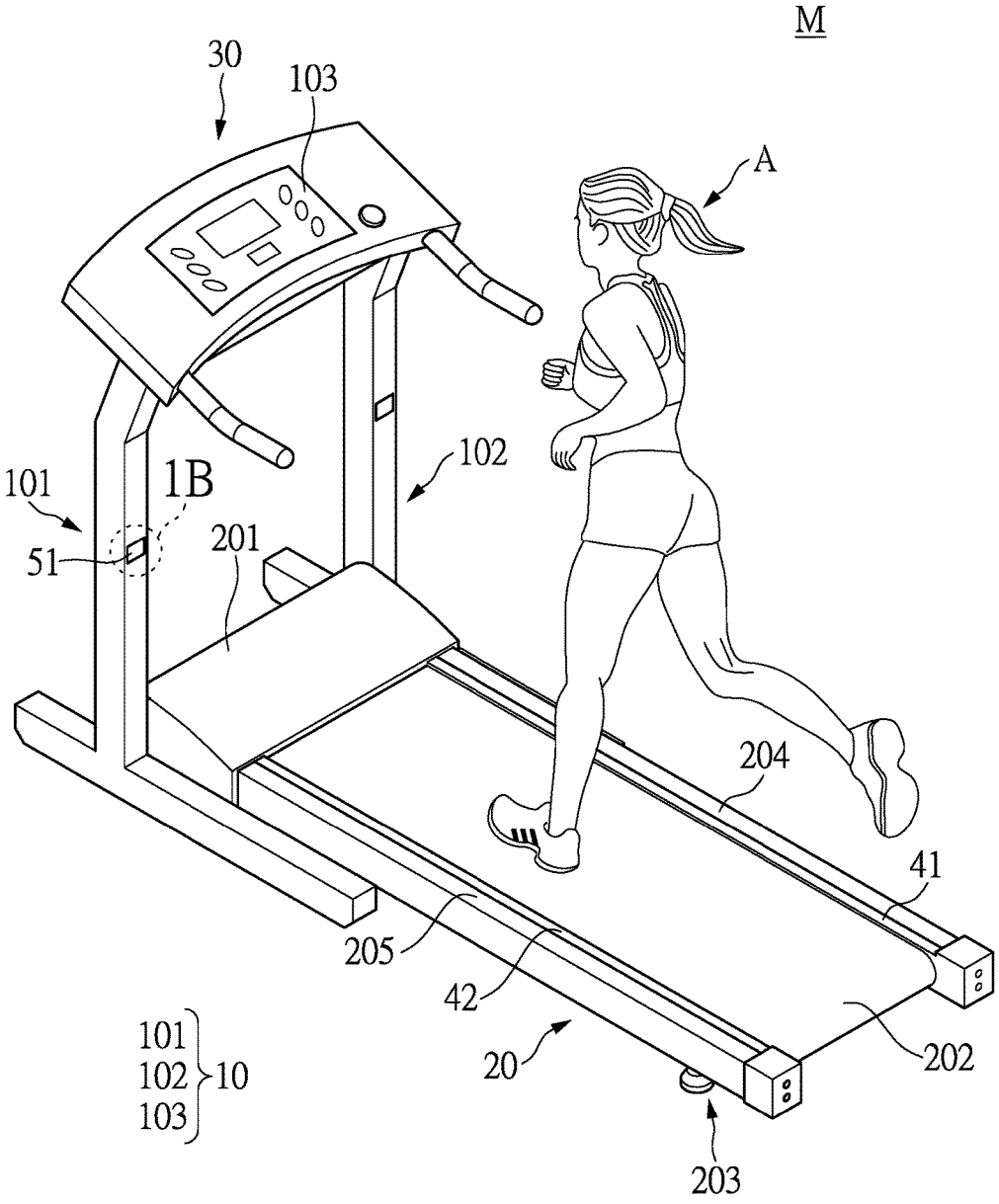
FIG. 1A is a schematic diagram illustrating a treadmill according to one embodiment of the present disclosure.

With reference to FIG. 1A, the present disclosure provides a treadmill M including a treadmill belt 20, a first signal member, a first sensor 51 and a controller 30. The first signal member is disposed at position near a first side 204 of the treadmill belt 20. The controller 30 is coupled to the first sensor 51. Specifically, the treadmill M further includes a frame body 10 and a control panel 103 disposed on the frame body 10. The controller 30 is disposed in the control panel 103 and provides the user with information such as the running rate, running time or warnings. The controller 30 can directly adjust the treadmill belt 20 based on the above information. The frame body 10 includes a first support rail 101 and a second support rail 102 that are disposed on both sides of the treadmill belt 20 at an end thereof. The first support rail 101 and the second support rail 102 extend upwardly. The first sensor 51 is disposed on the first support rail 101. It should be noted that the position where the first sensor 51 is disposed enables the first sensor 51 to retrieve the first light pattern provided by the first signal member, in which the first sensor 51 can retrieve the whole or a part of the first light pattern. For example, the first sensor 51 can retrieve three fourths or a half of the first light pattern; however, the present disclosure is not limited thereto. Furthermore, the treadmill belt 20 includes a walking belt 202 and a support base 203 that supports the walking belt 202.

The first signal member is used for providing light patterns. The first signal member can emit light so as to generate light patterns. Under such case the first sensor 51 can perform the detection of light patterns more effectively. The first signal member can be made of materials with high reflection coefficients which reflect light so as to provide the first sensor 51 with light patterns.

Specifically, the first signal member can be a light emitting component, such as infrared emitter, lase emitter, or LED. The first signal member can also be a reflective component with high reflection coefficient, such as a reflective belt or a retro reflector. The first signal member can also be formed of fluorescence glass balls, or include both a reflective belt and fluorescence glass balls. However, the present disclosure is not limited thereto. A person skilled in the art can choose the material of the first signal member according to actual needs. In the embodiments described below, the signal members are exemplified as reflective components, and the first signal member is a reflective component 41.

Figure 3:
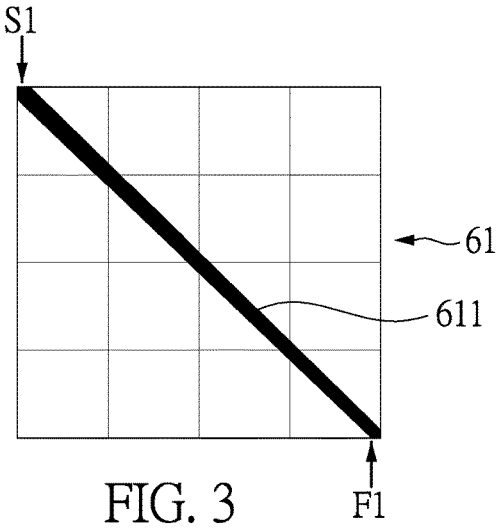
FIG. 3 is a schematic diagram of a first image according to one embodiment of the present disclosure.

The first sensor 51 is used for retrieving a first image that includes the first light pattern. Referring to FIG. 3, the first image 61 includes the first light pattern 611 provided by the first reflective component 41. The first light pattern 611 extends from the first starting point S1 of the first image 61. The image output an image information representing the original image, without outputting the original image so that the transmission load between the image sensor and external processor can be reduced. It should be noted that the present disclosure uses the term "image" to represent the original image and/or the image information of the original image.

Referring to FIG. 1A, the first sensor 51 is a complementary metal-oxide-semiconductor (CMOS) or a charge-coupled device (CCD), to which the present disclosure is not limited.

Figure 1B:
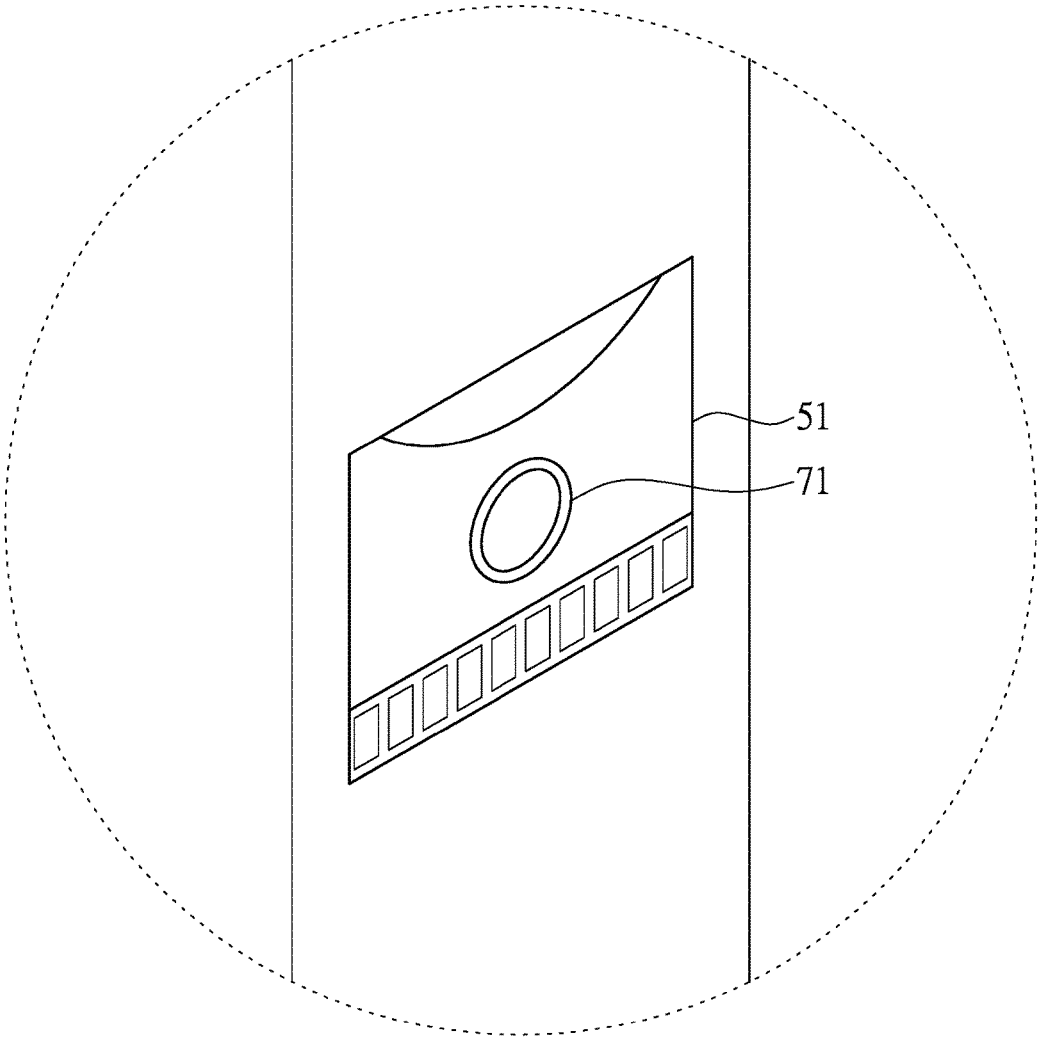
FIG. 1B is a schematic diagram illustrating a first sensor according to one embodiment of the present disclosure.

With reference to FIG. 1B and FIG. 3, the first sensor 51 can further include a first light emitter 71 that is disposed on the first sensor 51. The first light emitter 71 generates a light beam that illuminates the first reflective component 41 to further generate a first light pattern 611, thereby increasing the definition of the first light pattern 611 in the first image 61. The first light emitter 71 can be an LED that emits infrared light or light with a wavelength greater than 850 nm. It should be noted that the first light emitter 71 can be exemplified in different ways, and the present disclosure is not limited to the above examples.

In addition, in the present embodiment, the treadmill M includes a sensor and a reflective component; however, the present disclosure is not limited thereto. In other embodiments, the treadmill M can include a plurality of sensors and reflective components, in which the plurality of reflective components are disposed at lateral sides of the treadmill belt 20 and the sensors can retrieve light patterns provided by at least one of the reflective components. In the embodiments described below, the treadmill M includes one sensor and one reflective component.

In the present embodiment, the first sensor 51 outputs the first image 61 to the controller 30, which calculates the characteristic properties of the first light pattern 611 according to the first image 61. In other embodiments, the first sensor 51 can also include a first image-processing device (not shown in FIG. 1A). The first image-processing device receives the first image 61 and calculates the characteristic properties of the first light pattern 611 according to the first image 61. The first image-processing device then provides the controller 30 with the characteristic properties of the first light pattern 611, with which the controller 30 adjusts the treadmill belt 20 accordingly.

When a user is running on the treadmill M, the user's body will cover part of the first image 61 retrieved by the first sensor 51 and change the characteristic properties of the first light pattern 611. The characteristic properties of the first light pattern 611 can include the position and the length of the first light pattern 611, and the number of segments included in the first light pattern 611. Taking the length of the first light pattern 611 for example, when the user is running on the treadmill M, his/her feet will cover different parts of the first light pattern 611 such that the length of the first light pattern 611 changes while the user is running. More specifically, when the runner shifts towards the front end 201 of the treadmill belt 20, the first light pattern 611 becomes shorter; when the runner shifts towards the rear end of the treadmill belt 20, the first light pattern 611 becomes longer.

Through the above means, the relative position between the user and the front end 201 can be determined according to the length of the first light pattern 611. Furthermore, the step frequency can be determined based on the variation frequency of the length of the first light pattern 611. The step frequency can be a reference for the analysis of the user's exercise performance.

The controller 30 before calculates the length of the first light pattern 611 can define the first light pattern 611 based on the difference in brightness between the first light pattern 611 and the rest of the first image 61 (background image), and then the controller 30 calculate the length of the first light pattern 611 by determining the distance that the first light pattern 611 extends from the first starting point S1. The length of the first light pattern 611 may also be determined by the distance that the first light pattern 611 extends in a predetermined direction P, or the furthest distance the first light pattern 611 extends from the first starting point S1. In the present embodiment, the predetermined direction P refers to the direction in which the first light pattern 611 extends from the first starting point S1 to an end point F1.

Moreover, in the embodiment that the positions of the first sensor 51 and the first signal member are fixed, the length of the first light pattern 611 can be determined based on where the first light pattern 611 is located on the first image 61. For example, when the first light pattern 611 is in a first region of the first image 61, the representative length of the first light pattern 611 is X1, and when the first light pattern 611 is located at both the first region and a second region, the representative length of the first light pattern 611 is X2, in which X2 is longer than X1. Through the above means, the length of the first light pattern 611 can be determined and be referred to by the controller 30 when adjusting the operating speed of the treadmill belt 20.

With reference to FIG. 1A, the controller 30 adjusts the operating speed of the treadmill belt 20 according to at least one light pattern, e.g. the first light pattern 611. In this embodiment, the controller 30 receives the first image 61 and calculates the length of the first light pattern 611 according to the first image 61, and then adjusts the operating speed of the treadmill belt 20 accordingly. The technical aspects concerning the controller 30 is common knowledge in the art and thus will not be further explained herein.

Referring to FIG. 1A and FIG. 3, after a user presses the start button (not shown) on the treadmill M, the first sensor 51 retrieves the first image 61 after every specific time interval. The first image 61 contains the first light pattern 611 caused by light reflected from the first reflective component 41 to the first sensor 51. When there is no object A standing on the treadmill M, the light reflected by the first reflective component 41 will not be blocked, which corresponds to the first light pattern 611 in FIG. 3 that has a length being the distance between the first starting point S1 and the end point F1.

Figure 2:
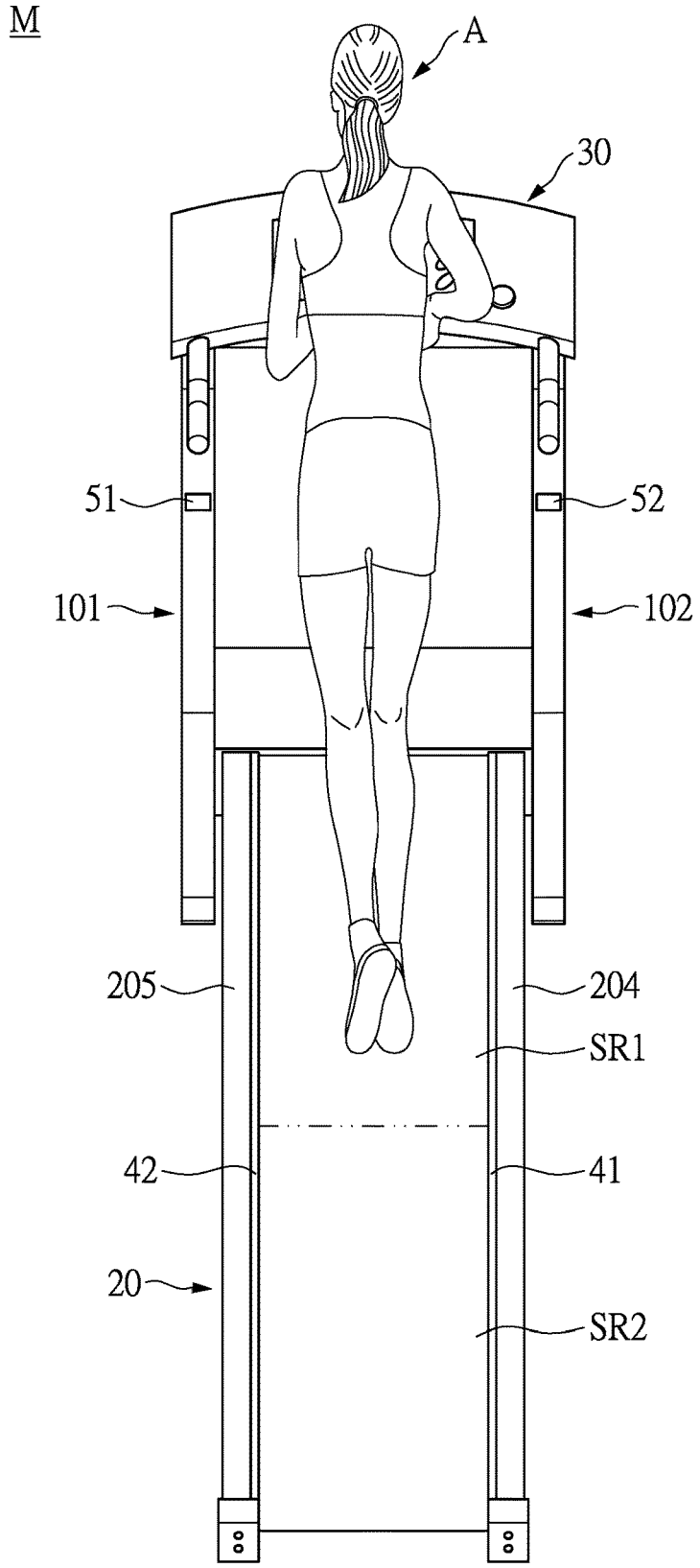
FIG. 2 is a schematic diagram illustrating the sensing areas on the treadmill belt of the treadmill according to one embodiment of the present disclosure.

Referring to FIG. 2, the treadmill M is divided into the first sensing area SR1 adjacent to the first sensor 51 and the second sensing area SR2 adjacent to the first sensing area SR1. The controller 30 determines whether the object A is in the first sensing area SR1 or the second sensing area SR2 according to the length of the first light pattern 611, and then adjusts the operating speed of the treadmill belt 20 accordingly. In practice, the treadmill belt 20 is divided into a front region (corresponding to the first sensing area SR1) and a rear region (corresponding to the second sensing area SR2) in this embodiment. The length of the first light pattern 611 when the first light pattern 611 is covered by the object A is used for determining at which region the object A is located.

Figure 4A:
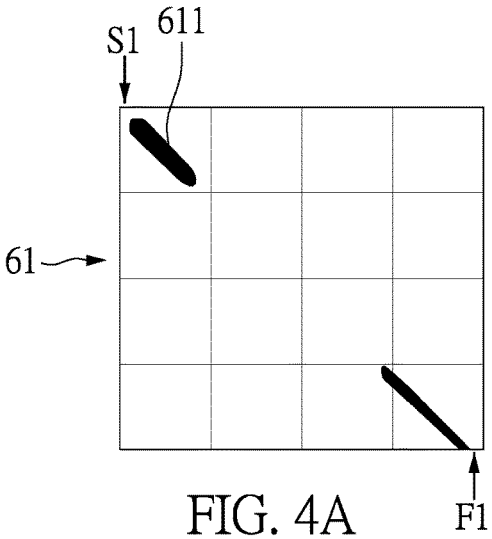
FIGS. 4A and 4B are two first images with different parts thereof being covered.
Figure 4B:
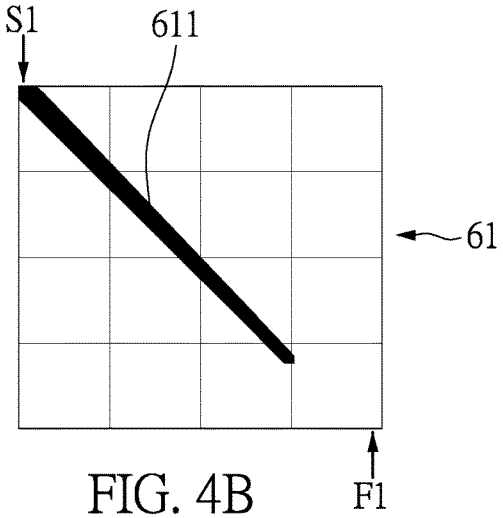

With reference to FIGS. 4A and 4B, when the object A is on the treadmill belt 20 of the treadmill M, the object A will be situated between the first sensor 51 and the first reflective component 41 and thus will block the light transmitted therebetween, rendering the first light pattern 611 shown in FIG. 4A or FIG. 4B.

Referring to FIG. 4A, when the length of the first light pattern 611 that extends from the first starting point S1 is smaller than a predetermined value TH1, the controller 30 determines that the object A is in the first sensing area SR1 of the treadmill belt 20 and increases the operating speed of the treadmill belt 20 accordingly. Specifically, the controller 30 determines that the object A is moving faster than the treadmill belt 20 operates, and then increases the operating speed of the treadmill belt 20 such that the treadmill belt 20 is moving at the same rate as the object A so that the object A can stay moving in the middle of the treadmill belt 20. In this embodiment, the first predetermined value TH1 is a half of the distance between the first starting point S1 and the end point F1. It should be noted that the value of the first predetermined value TH1 is not limited to the above example. A person skilled in the art can set the threshold value according to actual needs.

With reference to FIG. 4B, when the distance that the first light pattern 611 extends from the first starting point S1 is greater than the first predetermined value TH1, the controller 30 determines that the object A is in the second sensing area SR2 of the treadmill belt 20 and decreases the operating speed of the treadmill belt 20 accordingly. More specifically, the controller 30 determines that the object A is moving slower than the treadmill belt 20 operates, and then decreases the operating speed of the treadmill belt 20 such that the treadmill belt 20 is moving at the same rate as the object A so that the object A can stay moving in the middle of the treadmill belt 20.

The control method for controlling the treadmill belt of the treadmill M will be explained below. With reference to FIGS. 2, 4A, 4B and 11, in step S101, the first sensor 51 retrieves the first image 61 after every specific time interval. The first image 61 includes the first light pattern 611 provided by the first reflective component 41 and extending from the first starting point S1.

In step S102, the controller 30 receives the first image 61 and calculates the length of the first light pattern 611 based on the first image 61. In other embodiments, the first image-processing device of the first sensor 51 can receive the first image 61 and calculate the length of the first light pattern 611. Next, the first image-processing device outputs the length of the first light pattern 611 to the controller 30. In this way, controller 30 is not needed in calculating the length of the first light pattern 611 so that resources provided by the controller 30 can be spared. The way the length of the first light pattern 611 is measured has been explained above and will not be further explained herein.

In step S103, the controller 30 determines whether the length of the first light pattern 611 is greater than the first predetermined value TH1. If the length of the first light pattern 611 is not greater than the first predetermined value TH1, step S104 follows. On the other hand, if the length of the first light pattern 611 is greater than the first predetermined value TH1, step S105 follows. Specifically, the controller 30 determines whether the first light pattern 611 is in the first sensing area SR1 or in the second sensing area SR2 according to the length of the first light pattern 611, and then adjusts the operating speed of the treadmill belt 20 accordingly.

In step S104, the controller 30 determines that the object A is in the first sensing area SR1 of the treadmill belt 20, that is to say, the controller 30 determines that the speed at which the object A moves is higher than the operating speed of the treadmill belt 20. Next, the controller 30 increases the operating speed of the treadmill belt 20 through a driving module. Afterwards, step S101 follows. In step S105, the controller 30 determines that the speed at which the object A moves is lower than the operating speed of the treadmill belt 20. Next, the controller 30 decreases the operating speed of the treadmill belt 20 through a driving module. Afterwards, step S101 follows.

Steps S101 to S105 will be repeated until the stop button on the treadmill (not shown in FIGS. 1 and 2) is pressed. The start button and the stop button of the treadmill M can be the same button or two separate buttons.

In addition, the treadmill M can further include a second reflective component 42 and a second sensor 52. Referring to FIG. 2, the second reflective component 42 is disposed on the second side 205 and corresponds to the first reflective component 41. The second sensor 52 is coupled to the controller 30 and disposed on the second support rail 102. It should be noted that the first sensor 51 can be disposed at a position where the first sensor 51 can detect the light reflected by the first reflective component 41 and the second reflective component 42, in which the second sensor 52 omitted.

The second reflective component 42 has a high reflection coefficient and can be made of materials that are the same as or different from that of the first reflective component 41. A person skilled in the art can choose the material of the second reflective component 42 according to actual needs.

The second sensor 52 retrieves a second image, which includes a second light pattern caused by light reflected by the second reflective component 42. The second light pattern extends from a second starting point S2 and, as with the first image 61, changes according to the position of the object A.

Figure 11:
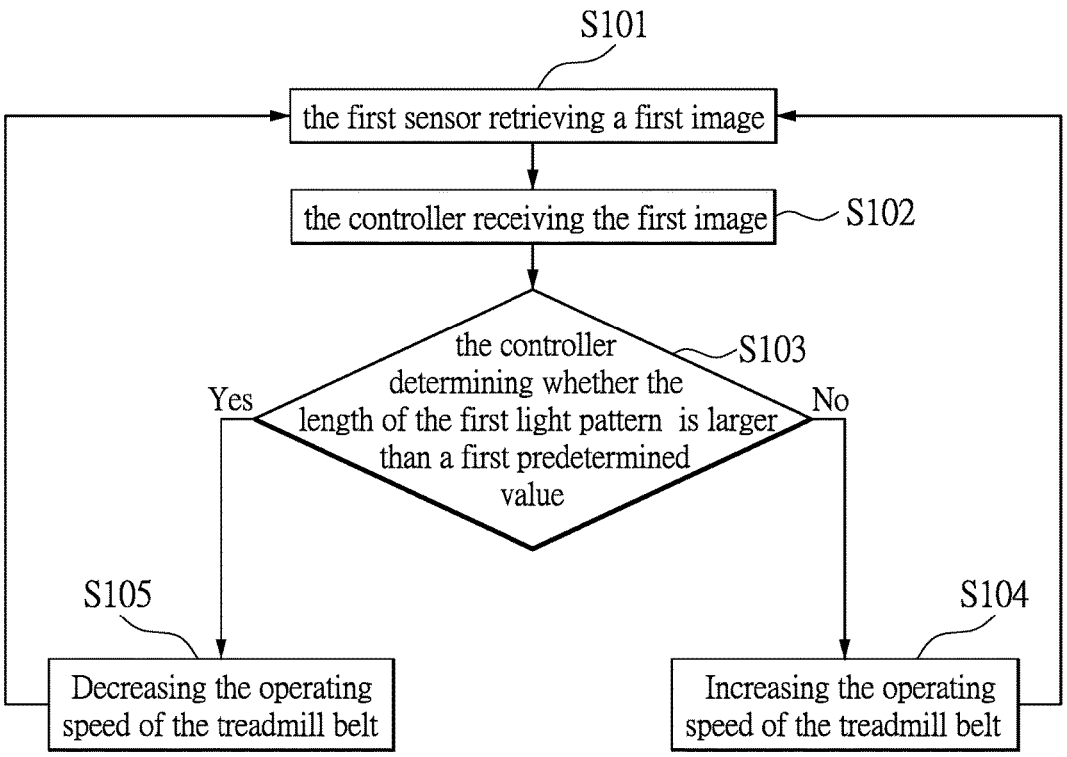
FIG. 11 is a flow chart illustrating a control method for controlling the treadmill belt of a treadmill according to one embodiment of the present disclosure.

The controller 30 can also determine whether the object A is in the first sensing area SR1 or second sensing area SR2 according to at least one of the length of the first light pattern 611 and the length of the second light pattern, in which the determination method is similar to the control method shown in the flow chart of FIG. 11.

More specifically, when the length of the first light pattern 611 changes and that of the second light pattern is not affected by the object A, the controller 30 adjusts the operating speed of the treadmill M according to the first image 61. When the length of the second light pattern changes and that of first light pattern 611 is not affected by the object A, the controller 30 adjusts the operating speed of the treadmill M according to the second image. When the length of the first light pattern 611 and the second light pattern both change, the controller 30 adjusts the operating speed of the treadmill M according to any one of the first image 61 and the second image.

Furthermore, the present disclosure is not limited by the positions at which the first sensor 51, the second sensor 52, the first reflective component 41, and/or second reflective component 42 are disposed as long as the first sensor 51 can detect the light reflected by the first reflective component 41 when there is no object on the treadmill M. The first sensor 51 can retrieve the whole first light pattern 611 or a part of the first light pattern 611, e.g. three fourths or a half of the first light pattern 611. However, the present disclosure is not limited thereto. In other embodiments, when an object A (user) is running on the treadmill M, the light reflected by the first reflective component 41 will be blocked by the object A, and then the controller 30 adjusts the treadmill belt 20 according to the characteristics of the first light pattern 611; when there is no object A (the user) on the treadmill M, the second sensor 52 can detect the light reflected by the second reflective component 42, in which the second sensor 52 can retrieve the whole second light pattern or a part of the second light pattern, e.g. three fourths or a half of the second light pattern. When the object A is using the treadmill M, the light reflected by the second reflective component 42 will be blocked by the object A, and then the controller 30 adjusts the treadmill belt 20 according to the characteristics of the second light pattern.

Moreover, the second sensor 52 can further include a second image-processing device that retrieves the second image and calculates the length of the second light pattern according to the second image. Next, the second processing device outputs the length of the second light pattern to the controller 30. The way in which the second image-processing device calculates the length of the second light pattern is similar to that used to calculate the length of the first light pattern 611, and will not be further explained herein.

Furthermore, the second sensor 52 of the present disclosure further includes a second light emitter that provides light towards the second reflective component 42. The second reflective component 42 reflects the light so as to generate the second light pattern. The second sensor 52 can be the same type of sensor as the first sensor 51. The first sensor 51 and the second sensor 52 can be different types of sensors. The technical aspects relating to a sensor is common knowledge in the art, and thus will not be further explained herein.

Through the aforementioned technical means, the treadmill M of the present disclosure can adjust the operating speed of the treadmill belt 20 according to the position of the user, thereby providing a speed that is appropriate for the user. Accordingly, the user of the treadmill M does not need to press any button on the treadmill M to adjust the operating speed, and when the user is too tired to keep up with the speed of the treadmill M, the treadmill M will automatically slow down or shut down, which prevents accidents from happening. It should be noted that the controller 30 can output information related to the treadmill belt 20 to the control panel 103 so that the control panel 103 will alert the user, through lights or sounds that the operation of the treadmill M is about to be adjusted. In addition, the control panel 103 can display workout information in connection with the user, such as step frequency or running speed.

With reference to FIG. 5 and FIGS. 6A to 6C, the specific structure of the treadmill M' according to another embodiment of the present disclosure is similar to that of the treadmill M, and the differences therebetween will be explained below.

The treadmill belt 20' of the treadmill M' is divided into a first sensing area SR1', a second sensing area SR2', and a third sensing area SR3'. The second sensing area SR2' is between the first sensing area SR1' and the third sensing area SR3'. The first sensing area SR1' is near the first sensor 51'. The first sensing area SR1', the second sensing area SR2', and the third sensing area SR3' are arranged in sequence along a track direction Z. Specifically, the first sensing area SR1', the second sensing area SR2', and the third sensing area SR3' correspond to the front region, the middle region and the rear region of the treadmill belt 20' respectively.

The controller 30' determines whether an object A' is in the first sensing area SR1', the second sensing area SR2' or the third sensing area SR3' according to the length of the first light pattern 611' and then adjusts the operating speed of the treadmill belt 20' accordingly. More specifically, the controller 30' determines whether the object A' is in the first sensing area SR1' or the second sensing area SR2' using a second predetermined value TH2, and then determines whether the object A' is in the second sensing area SR2' or the third sensing area SR3' using a third predetermined value TH3. The determination methods involved will be further described below.

Figure 5:
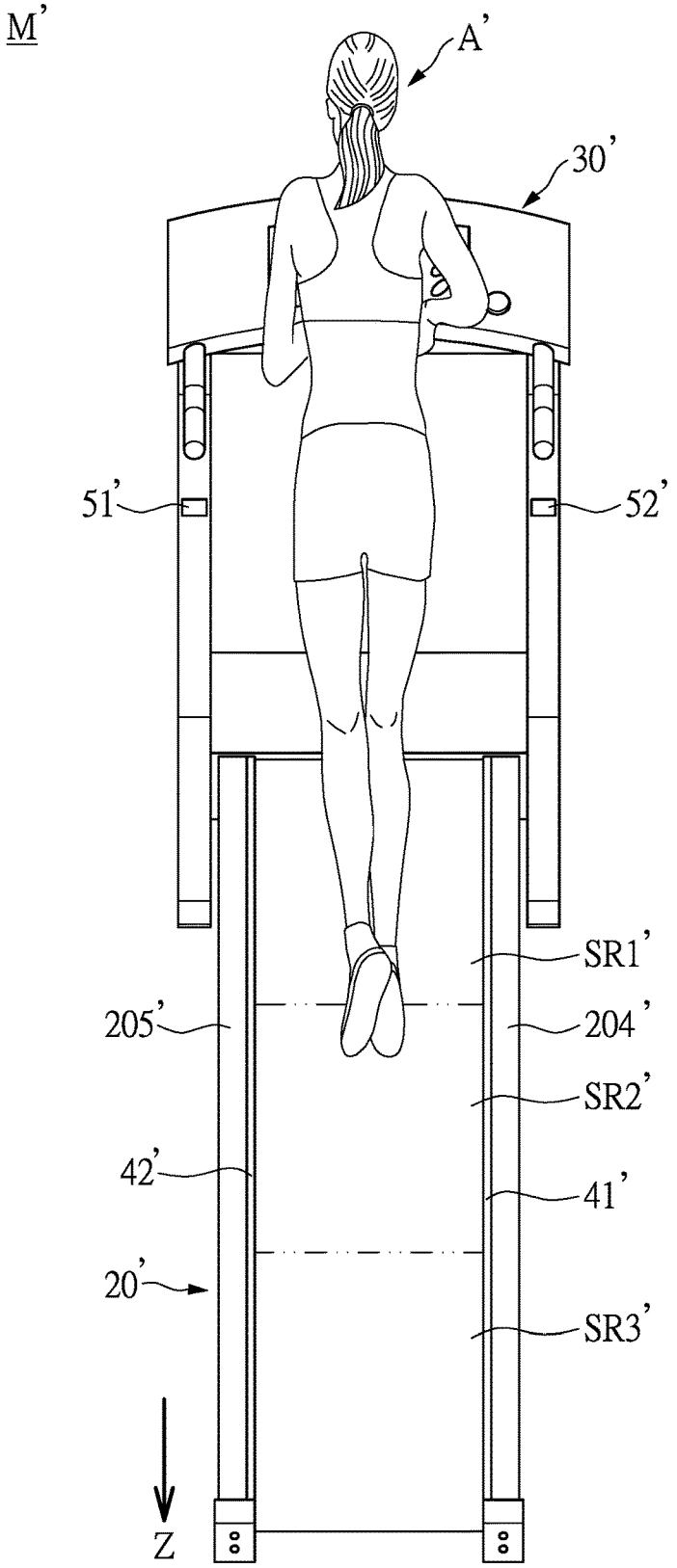
FIG. 5 is a schematic diagram illustrating the sensing areas on the treadmill belt of the treadmill according to one embodiment of the present disclosure.
Figure 12:
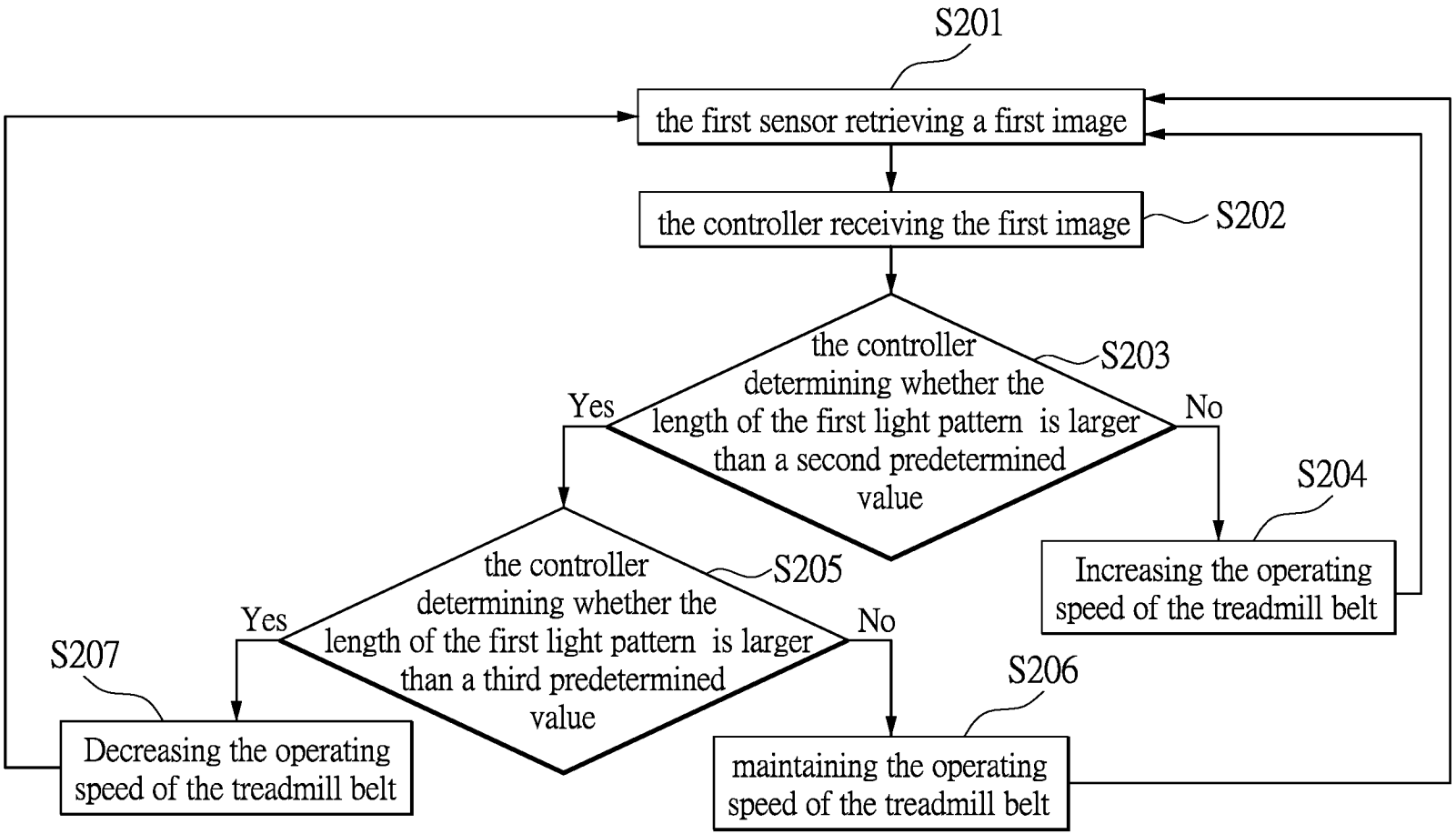
FIG. 12 is a flow chart illustrating the control method for controlling the treadmill belt of a treadmill according to another embodiment of the present disclosure.

With reference to FIG. 5, FIGS. 6A to 6C and FIG. 12, the control method in FIG. 12 is applicable to the treadmill M' shown in FIG. 5. Steps S201 and S202 are identical to steps S101 and S102, and thus will not be explained herein. Steps S203 to S207 will be explained below.

In step S203, the controller 30' determines whether the object A' is in the first sensing area SR1' of the treadmill belt 20' by determining whether the length of the first light pattern 611' is greater than the second predetermined value TH2.

Figure 6A:
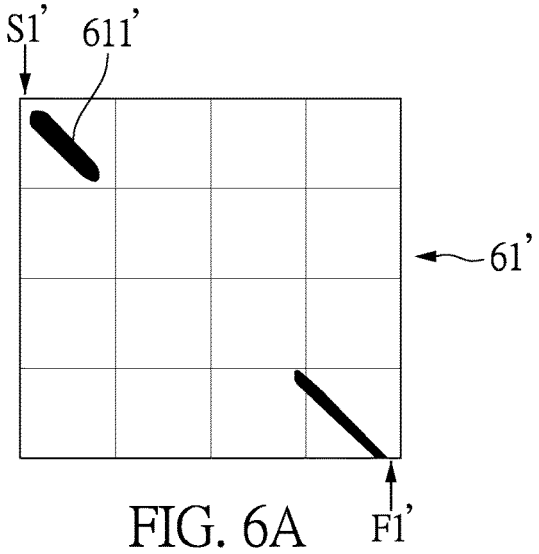
FIGS. 6A to 6C are the first images with different parts thereof being covered.

As shown in FIG. 6A, if the length of the first light pattern 611' of the first image 61' is greater than the second predetermined value TH2, the controller 30' determines that the object A' is in the first sensing area SR1' of the treadmill belt 20', i.e. the front region of the treadmill belt 20'. Specifically, the controller 30' determines that the speed at which the object A' moves is greater than the operating speed of the treadmill belt 20'. Next, step S204 follows. In step S204, the controller 30' increases the operating speed of the treadmill belt 20' such that the treadmill belt 20' moves as fast as the object A' so that the object A' can stay running in the middle of the treadmill belt 20'. Next, step S201 follows. When the length of the first light pattern 611' is greater than the second predetermined value TH2, step S205 is performed. In step S205, the controller 30' determines whether the length of the first light pattern 611' is greater than the third predetermined value TH3, thereby determining whether the object A' is in the second sensing area SR2' or the third sensing area SR3' of the treadmill belt 20'.

Figure 6B:
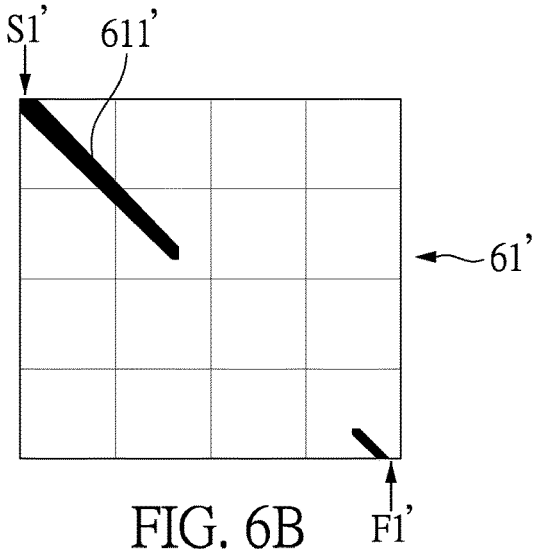

Referring to FIG. 6B, when the length of the first light pattern 611' is not greater than the third predetermined value TH3, i.e. the length of the first light pattern 611' is between the second predetermined value TH2 and the third predetermined value TH3, the controller 30' determines that the object A' is in the second sensing area SR2' of the treadmill belt 20', i.e. the user is in the middle region of the treadmill belt 20'. In this step, the controller 30' determines that the object A' is moving as fast as the treadmill belt 20', and then step S206 follows. In step S206, the controller 30' maintains the operating speed of the treadmill belt 20', and then the control method returns to step S201.

Figure 6C:
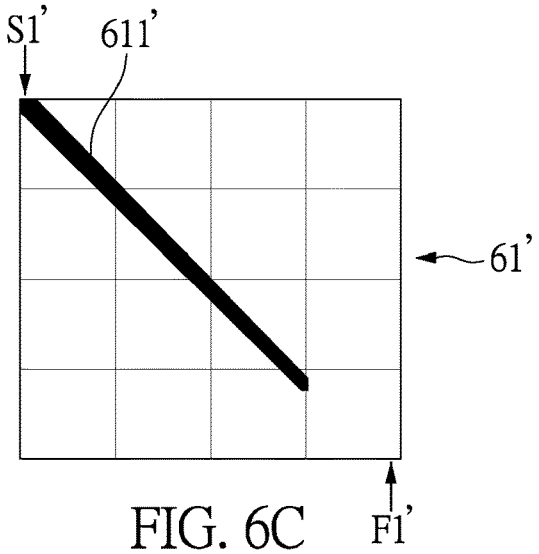

As shown in FIG. 6C, the controller 30' determines that the object A' is in the third sensing area SR3' of the treadmill belt 20' when the length of the first light pattern 611' is greater than the third predetermined value TH3, i.e. the controller 30' determines that the object A' is in the rear region of the treadmill belt 20'. The controller 30' then determines that the object A' moves at a speed lower than the operating speed of the treadmill belt 20'. Afterwards, step S207 follows. In step S207, the controller 30' decreases the operating speed of the treadmill belt 20' such that the treadmill belt 20' moves at the same rate as the object A'. Next, step S201 is returned to, and the control method begins anew.

Similarly, steps S201 to S207 will be repeated until the stop button on the treadmill M' (not shown in FIG. 5) is pressed.

It should be noted that the second predetermined value TH2 is one third of the distance between the first starting point S1' and the end point F1'. The third predetermined value TH3 is two thirds of the distance between the first starting point S1' and the end point F1'. However, the present disclosure is not limited thereto. A person skilled in the art can set the second predetermined value TH2 and the third predetermined value TH3 according to actual needs.

In addition, the treadmill M' of FIG. 5 can further include a second reflective component 42' and a second sensor 52'. The positions of the second reflective component 42' and the second sensor 52' and the structural relationship therebetween are similar to those of the second reflective component 42 and the second sensor 52 in the aforementioned embodiment, and therefore will not be further described herein.

The second sensor 52' retrieves a second image, which includes the second light pattern provided by the second component 42'. The second light pattern of the second image changes according to the positions of the object A' in a way that is similar to the way the first image 61' changes.

The controller 30' determines whether the object A' is in the first sensing area SR1', second sensing area SR2', or third sensing area SR3' of the treadmill belt 20' according to at least one of the length of the first light pattern 611' and that of the second light pattern. Next, the controller 30' adjusts the operating speed of the treadmill belt 20' according to the position of the object A'. The way that the controller 30' determines the length of the first light pattern 611' and that of the second light pattern is similar to the flow chart shown in FIG. 12.

Specifically, when the length of the first light pattern 611' changes and the second light pattern is not affected by the object A, the controller 30' retrieves the first image 61' to adjust the operating speed of the treadmill M'. When the first light pattern 611' is not affected by the object A and the second light pattern changes, the controller 30' retrieves the second image to adjust the operating speed of the treadmill M'.

In addition, the second sensor 52' of the present embodiment can further include a second image-processing device and a second light emitter. The second image-processing device can calculate the length of the second image in a way that is similar to the way the length of the first light pattern 611' is calculated, the details of which will not be reiterated herein.

It should be noted that, in the present embodiment, the treadmill belt 20' is divided into three detection areas; however, the present disclosure is not limited thereto. In other embodiments, the treadmill belt 20' can be divided into as many areas as needed. The number of detection areas can be varied according to actual needs.

Figure 7:
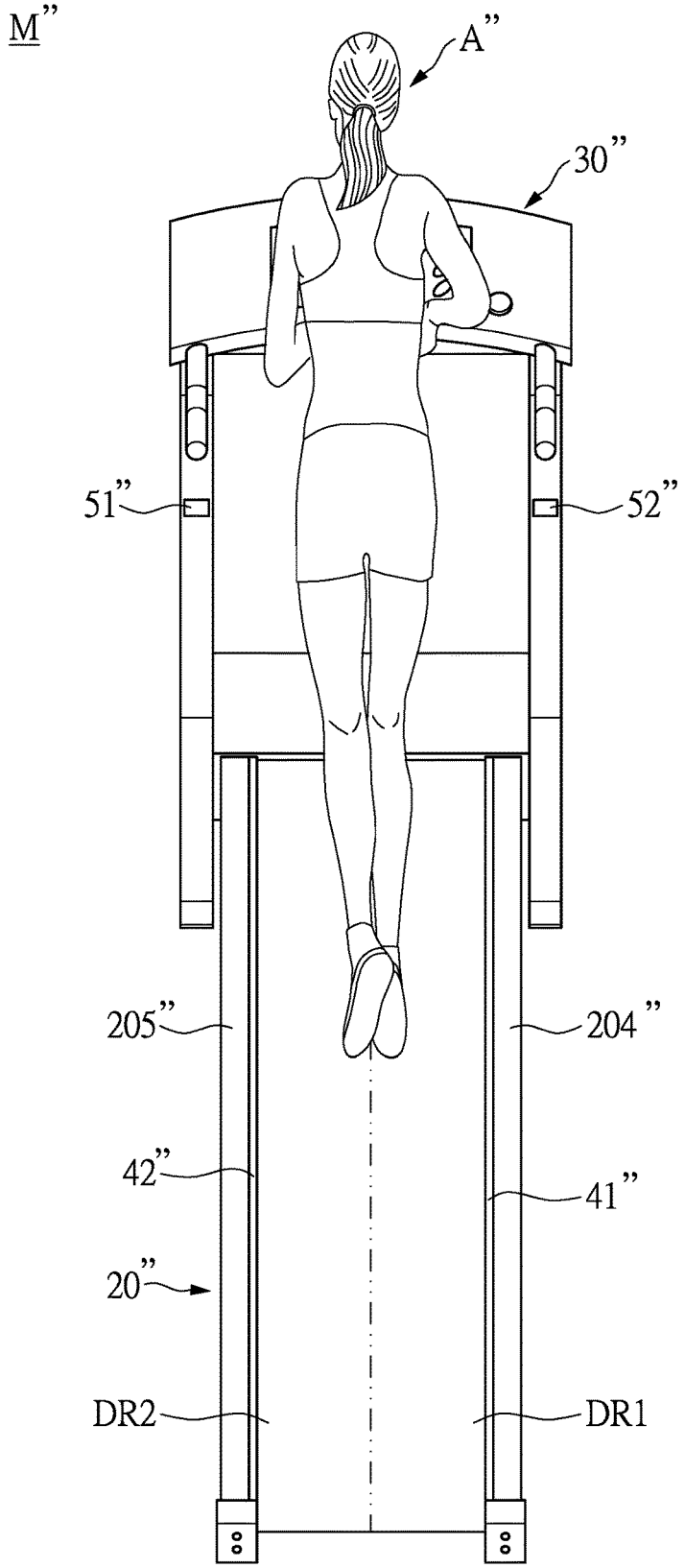
FIG. 7 is a schematic diagram illustrating the sensing areas on the treadmill belt of the treadmill according to one embodiment of the present disclosure.

Referring to FIG. 7, in this embodiment, the treadmill M" includes a treadmill belt 20", a first sensor 51", a second sensor 52", and a controller 30". A first reflective component 41" is disposed at a position near a first side 204" of the treadmill belt 20" and a second reflective component 42" is disposed at a position near a second side 205" of the treadmill belt 20". The second side 205" is on the opposite side of the first side 204". The first sensor 51" and the second sensor 52" are identical to the first sensors and the second sensors in the aforementioned embodiments, and therefore will not be further explained herein.

Figure 8A:
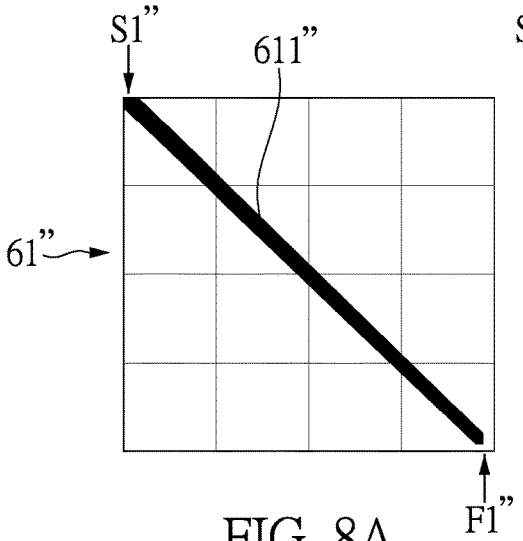
FIGS. 8A and 8B respectively show a first image and a second image according to one embodiment of the present disclosure.
Figure 8B:
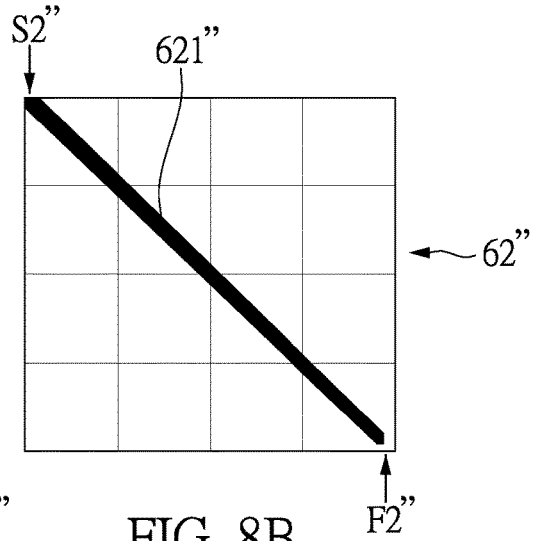

With reference to FIG. 7 and FIGS. 8A to 8B, the first sensor 51" retrieves the first image 61" shown in FIG. 8A by receiving the light reflected by the first reflective component 41". The second sensor 52" retrieves the second image 62" shown in FIG. 8B by receiving the light reflected by the second reflective component 42". The first light pattern 611" of the first image 61" extends from the first starting point S1" towards the end point F1". The second light pattern 621" of the second image 62" extends from the second starting point S2" towards the second end point F2". Afterwards, the length of the first light pattern 611" and that of the second light pattern 621" are applied to subsequent calculations performed by the controller 30".

The differences among the treadmill M" of the present embodiment, the treadmill M of FIG. 2 and the treadmill M' of FIG. 7 is that the treadmill belt 20" of the treadmill M" is divided into a first detection area DR1 adjacent to the first reflective component 41" and a second detection area DR2 neighboring the second reflective component 42". The controller 30" determines whether the object A" is in the first detection area DR1 or the second detection area DR2 according to the length of the first light pattern 611" or the second light pattern 621". In practice, the treadmill belt 20" is divided into left and right regions. The controller 30" determines in which region the object A" is located according to the length of the first light pattern 611" and that of the second light pattern 621" when the first light pattern 611" and the second light pattern 621" are covered.

FIG. 8A and FIG. 8B show a case in which the first sensor 51" and the second sensor 52" respectively retrieve the first image 61" and the second image 62" at the same time. In this embodiment, neither the first light pattern 611" of the first image 61" nor the second light pattern 621" of the second image 62" is affected by the object A". Accordingly, the controller 30" determines that there is no object on the treadmill belt 20".

Figure 13:
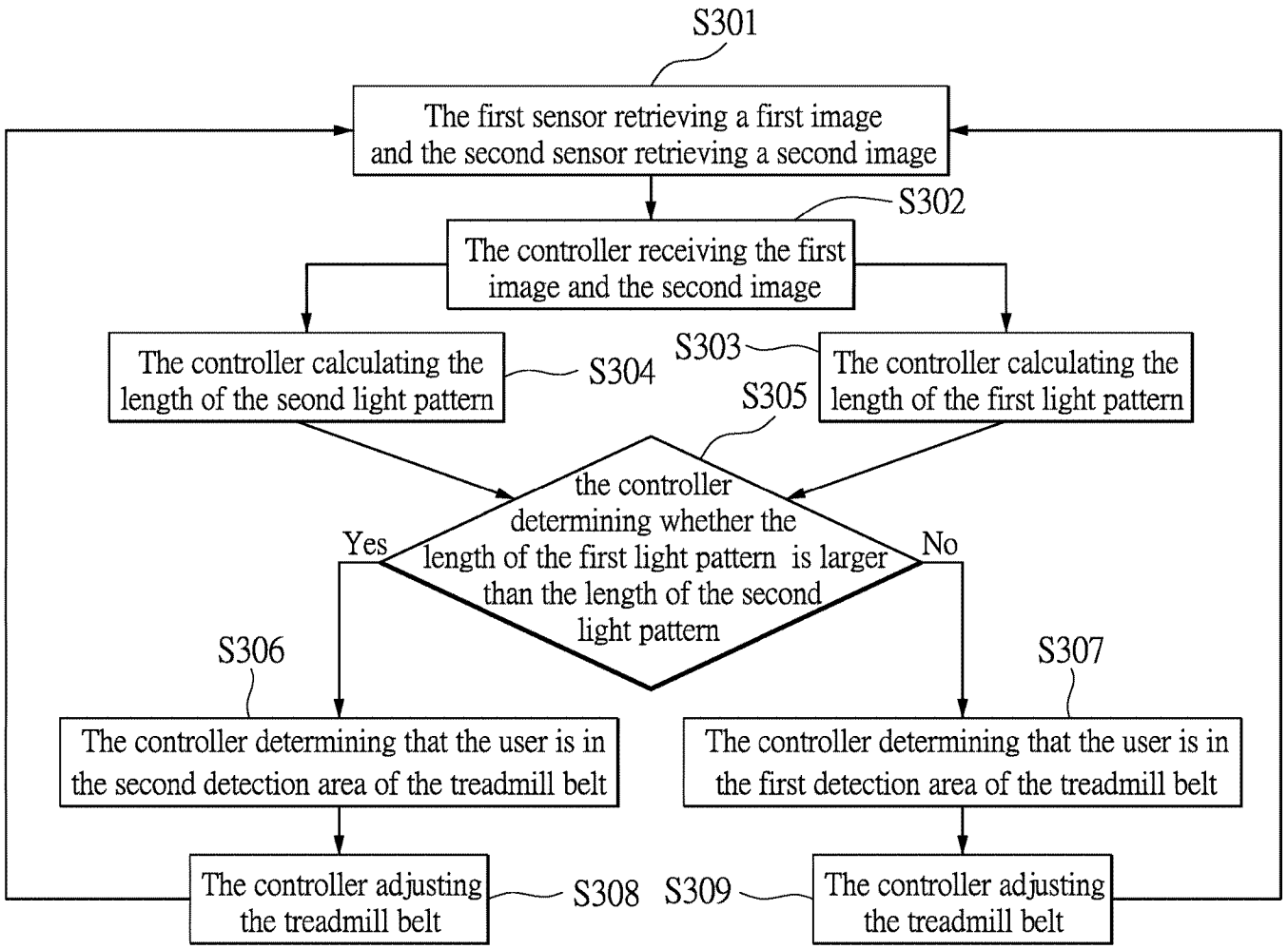
FIG. 13 is a flow chart illustrating the control method for controlling the treadmill belt of a treadmill according to yet another embodiment of the present disclosure.

The control method for controlling the treadmill belt 20" of the treadmill M" will be described below. With reference to FIGS. 7, 9A to 9B, 10A to 10B and 13, the control method shown in FIG. 13 is applied to the treadmill M" of FIG. 7. In step S301, the first sensor 51" retrieves the first image 61" after every specific time interval, and the second sensor 52" retrieves the second image 62" after every specific time interval.

In step S302, the controller 30" receives the first image 61" and the second image 62" at the same time, and then performs steps S303 and S304. In step S303, the controller 30" calculates the length of the first light pattern 611" according to the first image 61", and then step S305 follows. In step 304, the controller 30" calculates the length of the second light pattern 621" according to the second image 62", and then performs step S305. It should be noted that the method that the controller 30" adopts to calculate the lengths of the first light pattern 611" and the second light pattern 621" is similar to that described above, and thus will not be explained herein.

In step S305, the controller 30" determines whether the length of the first light pattern 611" is greater than that of the second light pattern 621". With the result of the determination, the controller 30" can determine at which part of the treadmill belt 20" the object A" is located and then adjust the treadmill belt 20" accordingly.

Figure 9A:
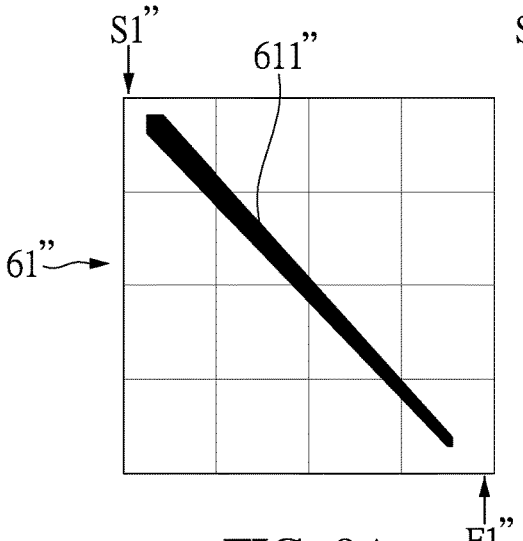
FIGS. 9A and 9B respectively show the first image and the second image retrieved when an object is in a first detection area.
Figure 9B:
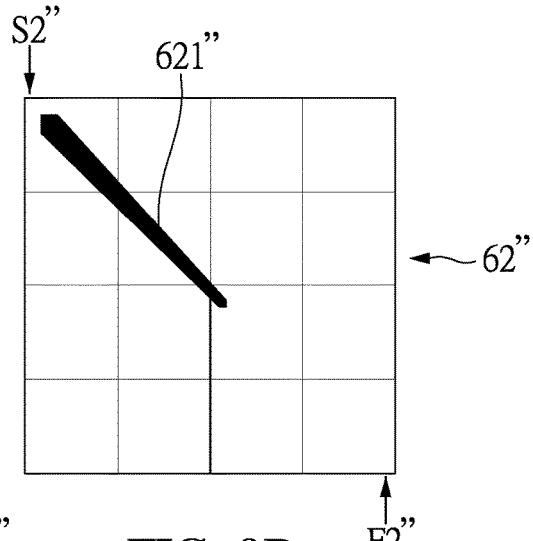

As shown in FIGS. 9A and 9B, if the length of the first light pattern 611" is greater than that of the second light pattern 621', step S306 is performed. In step S306, the controller 30" determines that the object A" is in the second detection area DR2 of the treadmill belt 20", that is to say, the light reflected by the second reflective component 42" is partly blocked by the user on the treadmill belt 20". The controller 30" therefore determines that the user is near the second reflective component 42", i.e. near the left side of the treadmill belt 20", and then performs step S308. In step S308, the controller 30" adjusts the treadmill belt 20" accordingly through a driving module (not shown in FIG. 7), e.g., the controller 30" increases the slope of the treadmill belt 20" from the left side so that the user shifts towards the other side of the treadmill belt 20", that is, the side adjacent to the first reflective component 41". Next, the control method returns to step S301.

Figures 10A, 10B:
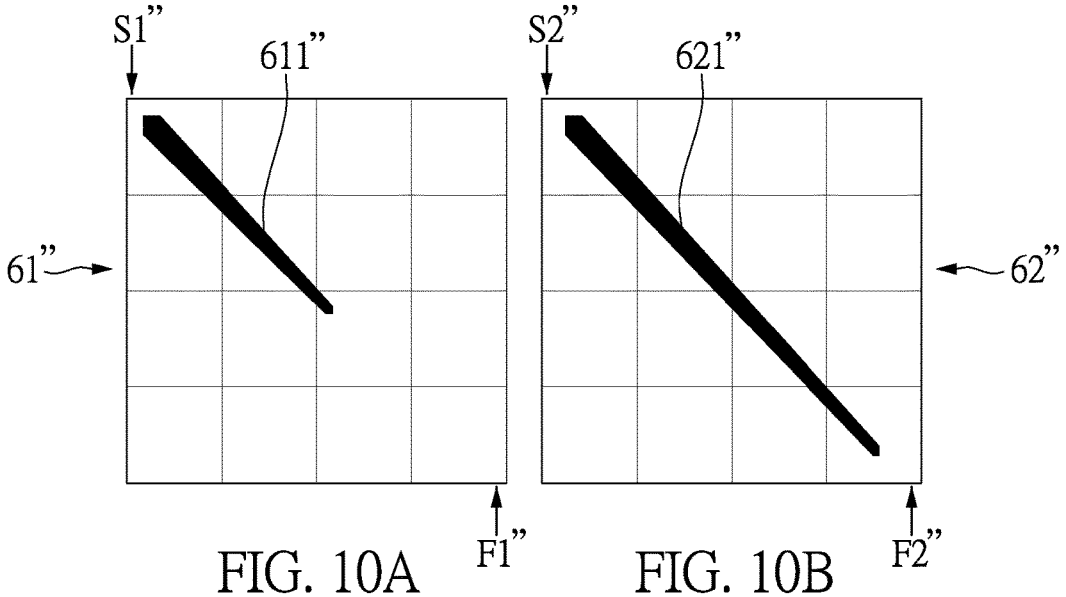
FIGS. 10A and 10B respectively show the first image and the second image retrieved when an object is in a second detection area.

With reference to FIG. 10A and FIG. 10B, if the length of the first light pattern 611" is not greater than that of the second light pattern 621", the controller 30" performs step S307. In step S307, the controller 30" determines that the object A" is located at the first detection area DR1 of the treadmill belt 20". In other words, the light reflected by the first reflective component 41" is blocked by the user on the right side of the treadmill belt 20". Next, the controller 30" performs step S309. In step S309, the controller 30" adjusts the treadmill belt 20" accordingly. For example, the controller 30" increases the slope of the treadmill belt 20" from the right side so that the user shifts towards the left side of the treadmill belt 20", i.e. the side near the second reflective component 42". Next, step S301 is returned to, and the control method begins anew.

Steps S301 to S309 will be repeated until the stop button (not shown in FIG. 7) is pressed.

Through the technical means provided by the present disclosure, the treadmill M" can adjust the treadmill belt 20" according to the position of the user. Therefore, when a user runs on one side of the treadmill belt 20" out of habit, the controller 30" will increase the slope of said side of the treadmill belt 20", thereby reducing the risk of a fall. Furthermore, through the constant adjustment of the treadmill belt 20", the user is able to stay running in the middle of the treadmill belt 20", which helps improve the running posture of the user and reduce uneven pressure distribution applied on the treadmill M", by which treadmill M" can have a longer lifespan.

Moreover, the controller 30" can also determine the exercise state of the object A" according to the length variation of the first light pattern 611" or the second light pattern 621" over time. More specifically, when in different exercise states, e.g. running and walking, the user's step frequency differs. Therefore, by calculating the length variations of the first light pattern 611" and second light pattern 621", the controller 30" can determine the exercise state of the user.

In addition, in other embodiments, the first reflective components (41, 41', 41") and the second reflective components (42, 42', 42") can be replaced by first light emitters and second light emitters respectively, in which the first light emitters project light onto the first sensor (51, 51', 51") so that the first sensor can retrieve the first light pattern, and the second light emitters project light onto the second sensor (52, 52', 52") so that the second sensor can retrieve the second light pattern.

Figure 14A:
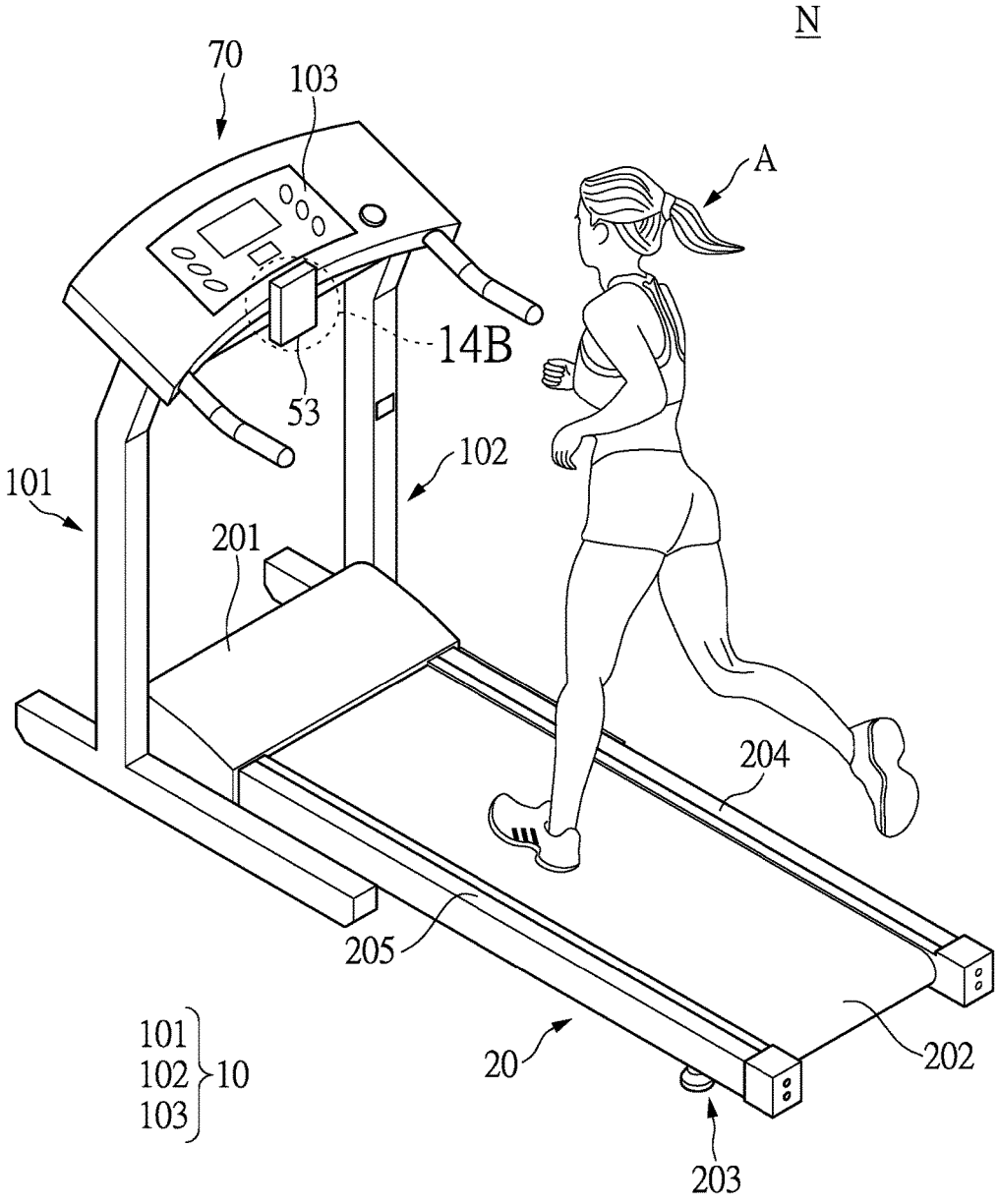
FIG. 14A is a flow chart illustrating the treadmill according to one embodiment of the present disclosure.
Figure 14B:
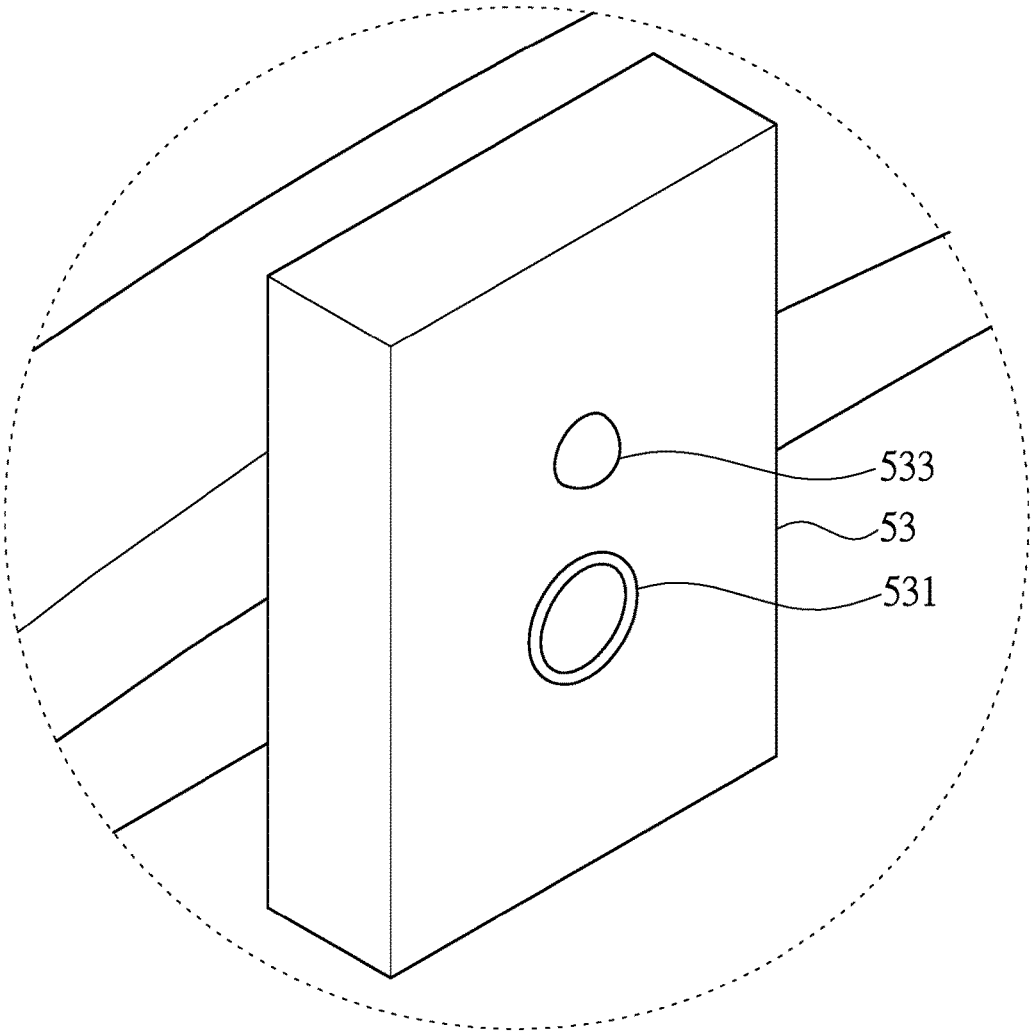
FIG. 14B is a schematic diagram illustrating an image sensor according to one embodiment of the present disclosure.

With reference to FIGS. 14A and 14B, the treadmill N provided by one embodiment of the present disclosure includes a treadmill belt 20, an image sensor 53, and a controller 70. The controller 70 is coupled to the image sensor 53. Specifically, the treadmill N further includes a frame body 10 and a control panel 103 disposed on the frame body 10. The controller 70 can be disposed in the control panel 103. The control panel 103 provides the user with information such as the running speed, running time and/or warnings. Furthermore, the control panel 103 can adjusts the treadmill belt 20 through the above mentioned information. The frame body 10 includes a first support rail 101 and a second support rail 102 that are disposed on both sides of the treadmill belt 20 at an end thereof. The first support rail 101 and the second support rail 102 extend upwardly. The treadmill belt 20 includes a walking belt 202 and a support base 203 that supports the walking belt 202. The object A refers to the user of the treadmill N.

As shown in FIG. 14B, the image sensor 53 includes an image sensing unit 531. In the present embodiment, the image sensor 53 further includes a light emitter 533. The light emitter 533 is a light source that emits invisible light, such as infrared or light with a wavelength greater than 850 nm. It should be noted that the light emitter 533 can be exemplified in other ways; the present disclosure is not limited to the above example.

In this embodiment, the treadmill N includes one image sensing unit and one light emitter; however, the present disclosure is not limited thereto. In other embodiments, the numbers of the image sensing unit and the light emitter can respectively be more than one.

The image sensing unit 531 of the image sensor 53 retrieves an image of the object A (the user of the treadmill N). The image sensing unit 531 retrieves the image of the object A after every specific time interval. The controller 70 adjusts the operating speed of the treadmill belt 20 according to the characteristic properties of the image. The characteristic properties can be the percentage of the pixels in the image that represent the object A or the distribution manner thereof.

Referring to FIGS. 14A and 15A to 15C, the image 151 is an image that contains the object A. The figure 1511 in the image 151 corresponds to the object A, which is formed of a plurality of pixels. Since the image sensor 53 is disposed at the front end of the treadmill N, the closer the object A is to the front end 201 of the treadmill N, the higher the percentage of pixels representing the object A is. In other words, the farther the object A is from the front end 201 of the treadmill N, the lower the percentage of the pixels representing the object A. The controller 70 can adjust the operating speed of the treadmill belt 20 according to the percentage of the pixels that constitute the figure 1511 such that the object A can remain in the middle of the treadmill belt 20.

Figure 15A:
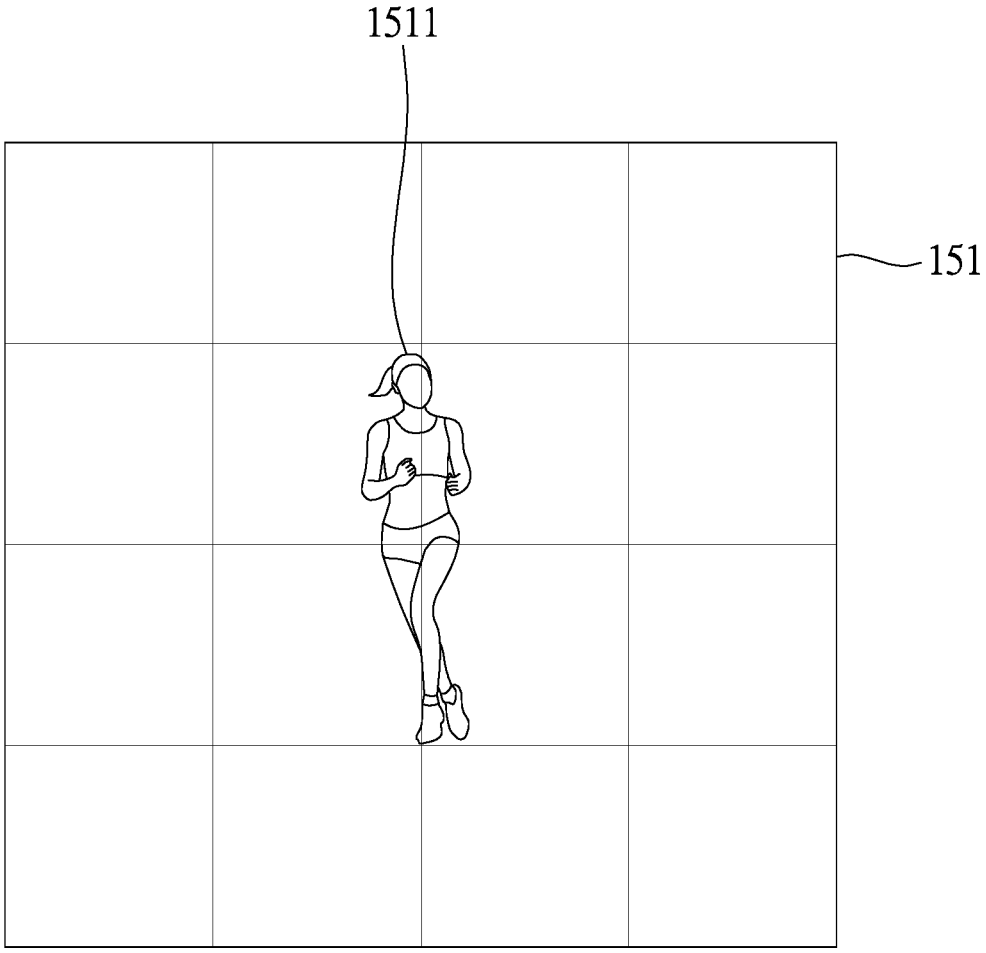
FIGS. 15A, 15B, and 15C show the images retrieved by the image sensing units according to one embodiment of the present disclosure.
Figure 15B:
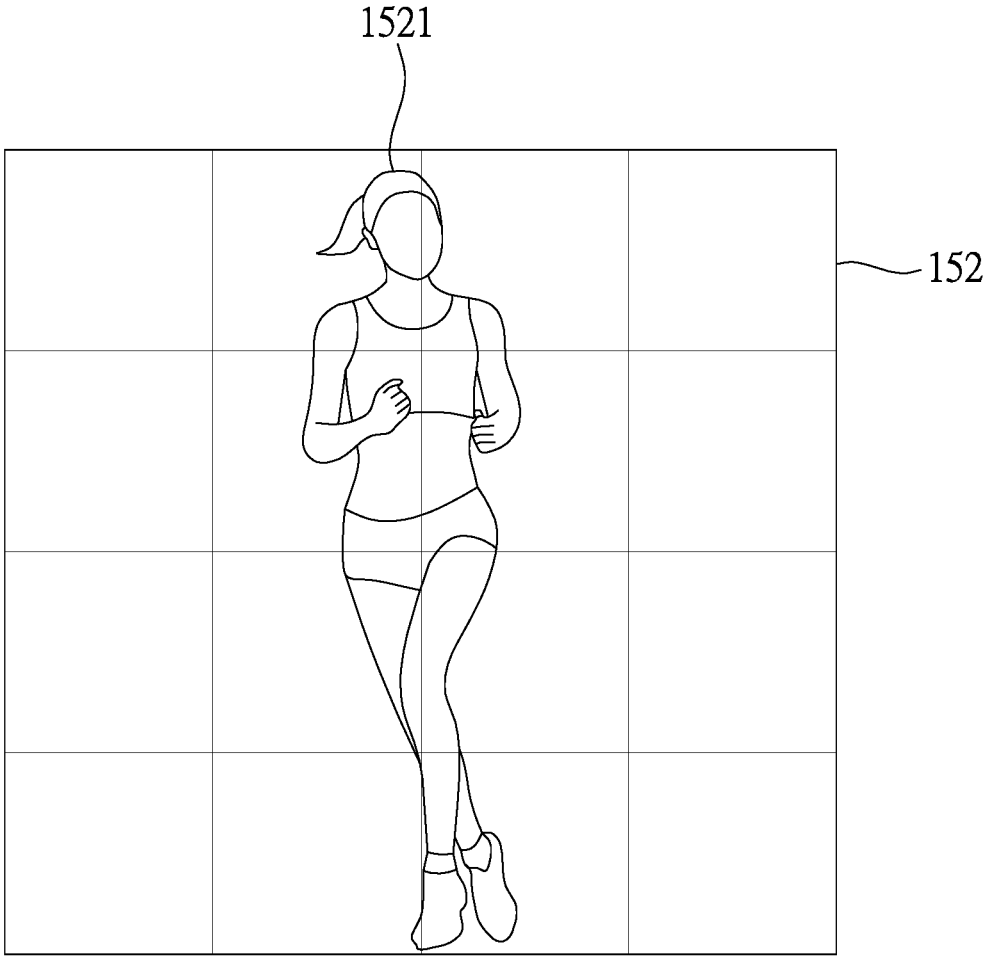

As shown in FIG. 15B, the image 152 retrieved by the image sensing unit 531 contains a figure 1521 that corresponds to the object A. In the image 152, the percentage of the pixels constituting the figure 1521 is higher than the percentage of the pixels constituting the figure 1511 in the image 151. Therefore, the object A is positioned closer to the front end 201 of the treadmill N in the embodiment shown in FIG. 15B than in the embodiment shown in FIG. 15A.

Figure 15C:
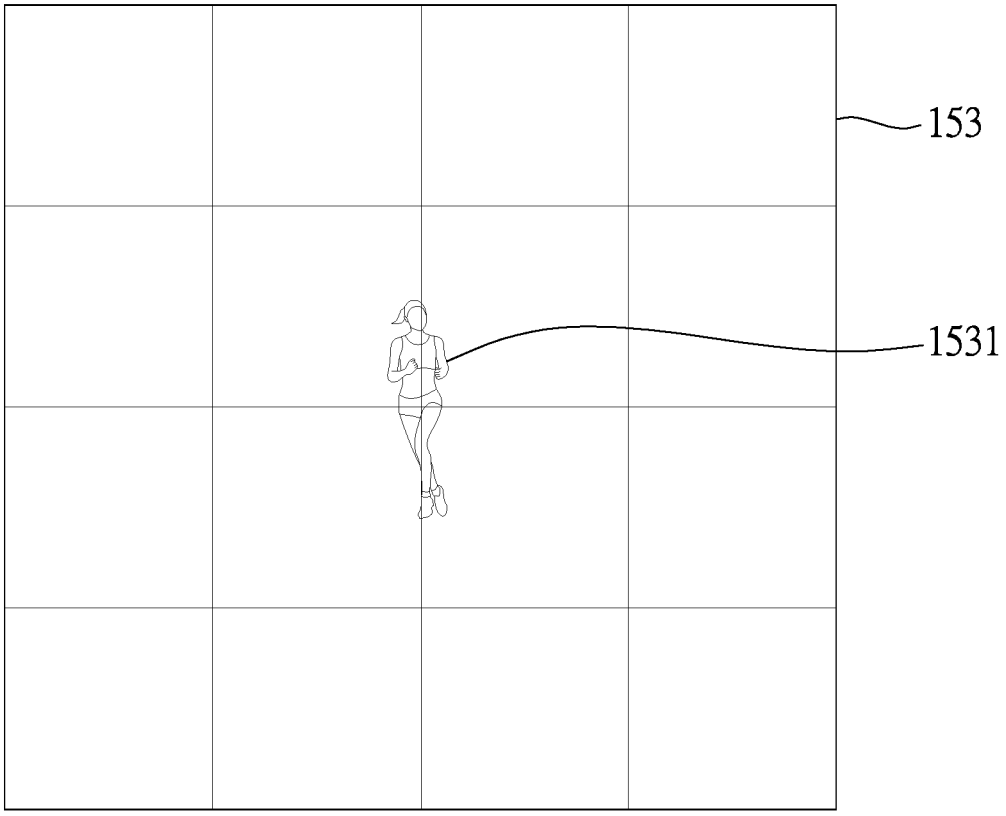

As shown in FIG. 15C, the image 153 contains a figure 1531 corresponding to the object A. In the image 153, the percentage of the pixels constituting the figure 1531 is lower than the percentage of the pixels constituting the figure 1511 in the image 151. Therefore, the object A is positioned farther from the front end 201 of the treadmill N in the embodiment shown in FIG. 15C than in the embodiment shown in FIG. 15A.

The controller 70 adjusts the operating speed of the treadmill belt 20 by the distance between the object A and the front end 201 according to the percentage of the pixels representing the object A in the image retrieved by the image sensor 53. In this way, the object A can remain in the middle of the treadmill belt 20.

In one embodiment, the controller 70 can determine whether the object A is moving faster or slower than the treadmill belt 20 by detecting and determining if the object A is too close to the front end 201 or too far from the front end 01 and then increase or decrease the operating speed of the treadmill belt 20 through a driving module (not shown) so that the object A can remain moving in the middle of the treadmill belt 20.

For example, when the number or percentage of the pixels corresponding to the object A in the image retrieved by the image sensing unit 531 is greater than a predetermined value then the controller 70 determines that the object A is too close to the front end 201. When the number or percentage of the pixels corresponding to the object A in the image retrieved by the image sensing unit 531 is smaller than a predetermined value then the controller 70 determines that the object A is too far from the front end 201.

Furthermore, the controller 70 can automatically start the treadmill belt 20 if the object A is too close to the front end 201. In that case, the distance between the object A and the front end 201 when the controller 70 starts the treadmill belt 20 can be smaller than the distance between the object A to the front end 201 when the controller starts increasing the operating speed of the treadmill belt 20.

The controller 70 also can automatically stop the treadmill belt 20 if the object A is too far from the front end 201. In that case, the distance from the object A to the front end 201 when the controller starts the treadmill belt 20 can be greater than the distance from the object A to the front end 201 when the controller starts decreasing the operating speed of the treadmill belt 20.

In one embodiment of the present disclosure, the controller 70 can determine whether the object A is gradually increasing or decreasing the running speed by detecting and determining if the number or percentage of the pixels corresponding to the object A in the image retrieved by the image sensing unit 531 gradually increases or decreases and then correspondingly increase or decrease the operating speed of the treadmill belt 20 through a driving module (not shown) so that the object A can remain moving in the middle of the treadmill belt 20.

In one embodiment of the present disclosure, the controller 70 can determine the step frequency of the user by calculating the variation frequency of the pixels in the image that correspond to the object A. The step frequency can be a reference for the user's exercise performance.

The technical aspects concerning the image sensor 53 and the controller 70 are common knowledge in the art, and therefore will not be further described herein.

In one embodiment of the present disclosure, the light emitter 533 of the image sensor 53 emits light that illuminates the object A. The image retrieved by the image sensing unit 531 includes a figure corresponding to the object A that is formed by light emitted from the light emitter 533 and reflected by a reflective component. The light emitter 533 can emit invisible light; however, the present disclosure is not limited thereto. In other embodiments, the light emitter 533 can emit both visible and invisible light so that the treadmill of the present disclosure can operate in any environment.

Through the technical means provided by the present disclosure, the treadmill N can start, stop, or adjust the treadmill belt 20 according to the position of the user, thereby providing the user with an appropriate operating speed that conforms to the physical condition of the user. The user does not need to press any button on the treadmill to adjust the operating speed of the treadmill belt. When the user is too tired to keep up with the speed of the treadmill belt 20, the treadmill will automatically slow down or shut down, reducing the risk of accidents when the user is unable to reach the stop button. It should be noted that the control panel 103 can inform the user of an upcoming adjustment of the treadmill N with alerting sounds or light. In addition, the control panel 103 can show the exercise information of the user, such as running speed or exercise state.

Figure 16:
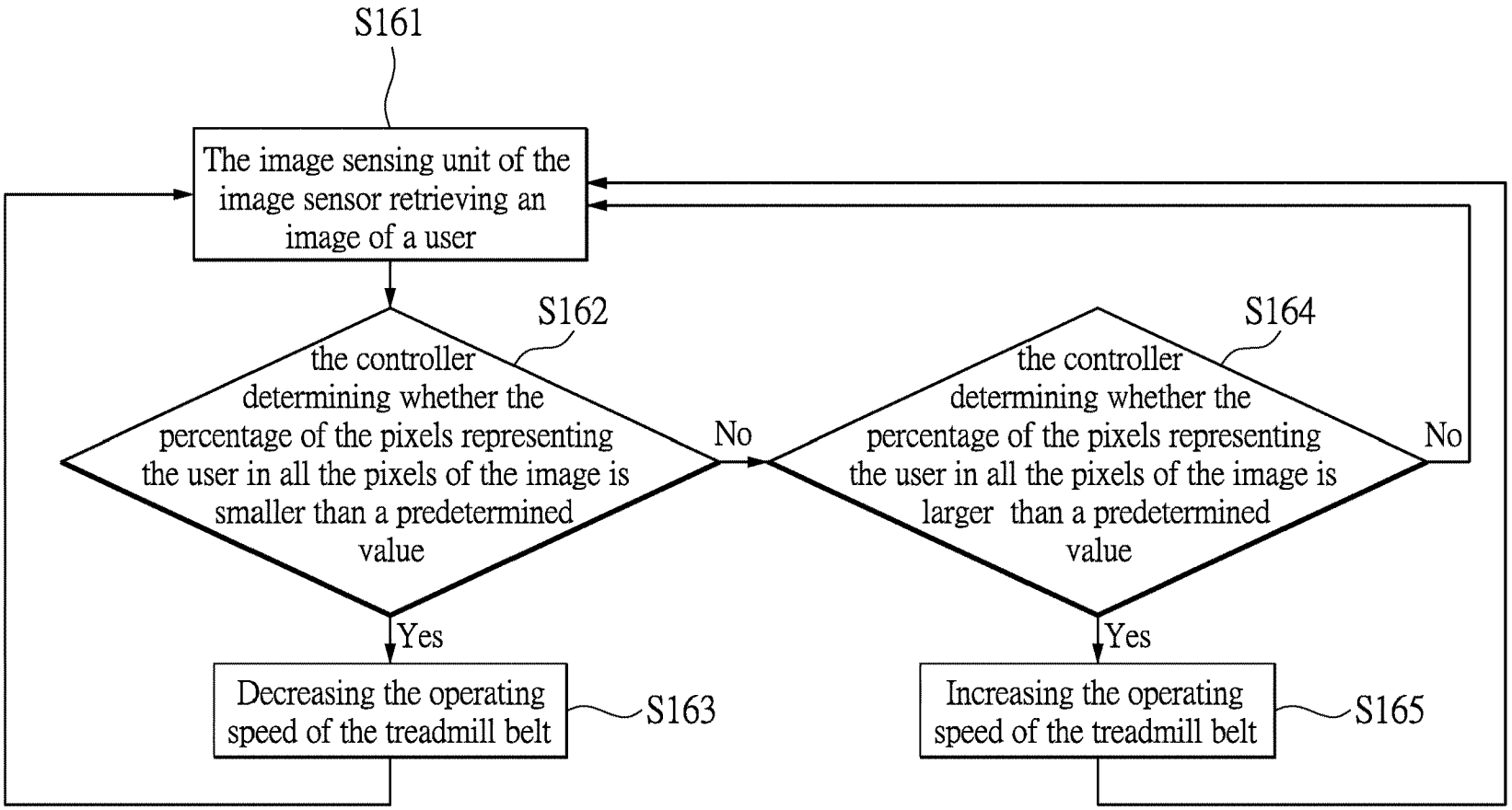
FIG. 16 is a flow chart illustrating a control method for controlling the treadmill belt of a treadmill according to another embodiment of the present disclosure.

The control method for controlling the treadmill belt of the treadmill N will be described below. With reference to FIGS. 14A, 14B and 16, the control method shown in FIG. 16 is applicable to the treadmill N shown in FIG. 14A. In the present embodiment, a predetermined value TH161 and a predetermined value TH163 can be set in the controller 70. The predetermined value TH161 and the predetermined value TH163 respectively represent a number or a percentage of the pixels corresponding to the object A in the image retrieved by the image sensing unit 531.

In step S161, the image sensing unit 531 of the image sensor 53 retrieves an image of the object A. The image sensing unit 531 contains a plurality of pixels, which means that every image retrieved by the image sensing unit 531 includes a plurality of pixels as well.

In step S162, the controller 70 determines whether the percentage of the pixels corresponding to the object A is smaller than the predetermined value TH161. If so, the controller 70 performs step S163. If not, the controller 70 performs step S164. In step S163, since the controller 70 determines that in the image retrieved by the image sensing unit 531, the percentage of the pixels corresponding to the object A is smaller than the predetermined value TH161, which means that the object A is too far from the front end 201 of the treadmill N and is moving slower than the treadmill belt 20, the controller 70 decreases the operating speed of the treadmill belt 20 through a driving module (not shown) accordingly so that the object A can remain in the middle of the treadmill belt 20. Next, the control method returns to step S161.

In step S164, the controller 70 determines whether the percentage of the pixels corresponding to the object A is greater than the predetermined value TH163. If so, the controller 70 performs step S165; if not, the controller 70 performs step S161. In step S165, since the controller 70 determines that in the image retrieved by the image sensing unit 531, the percentage of the pixels corresponding to the object A is greater than the predetermined value TH163, which means that the object A is too close to the front end 201 of the treadmill N and is moving faster than the treadmill belt 20, the controller 70 increases the operating speed of the treadmill belt 20 through a driving module (not shown) accordingly so that the object A can remain in the middle of the treadmill belt 20.

It should be noted that the predetermined value TH161 and the predetermined value TH163 described above are not to limit the scope of the present disclosure. A person skilled in the art can set up the predetermined value TH161 and predetermined value TH163 according to actual needs.

Figure 17:
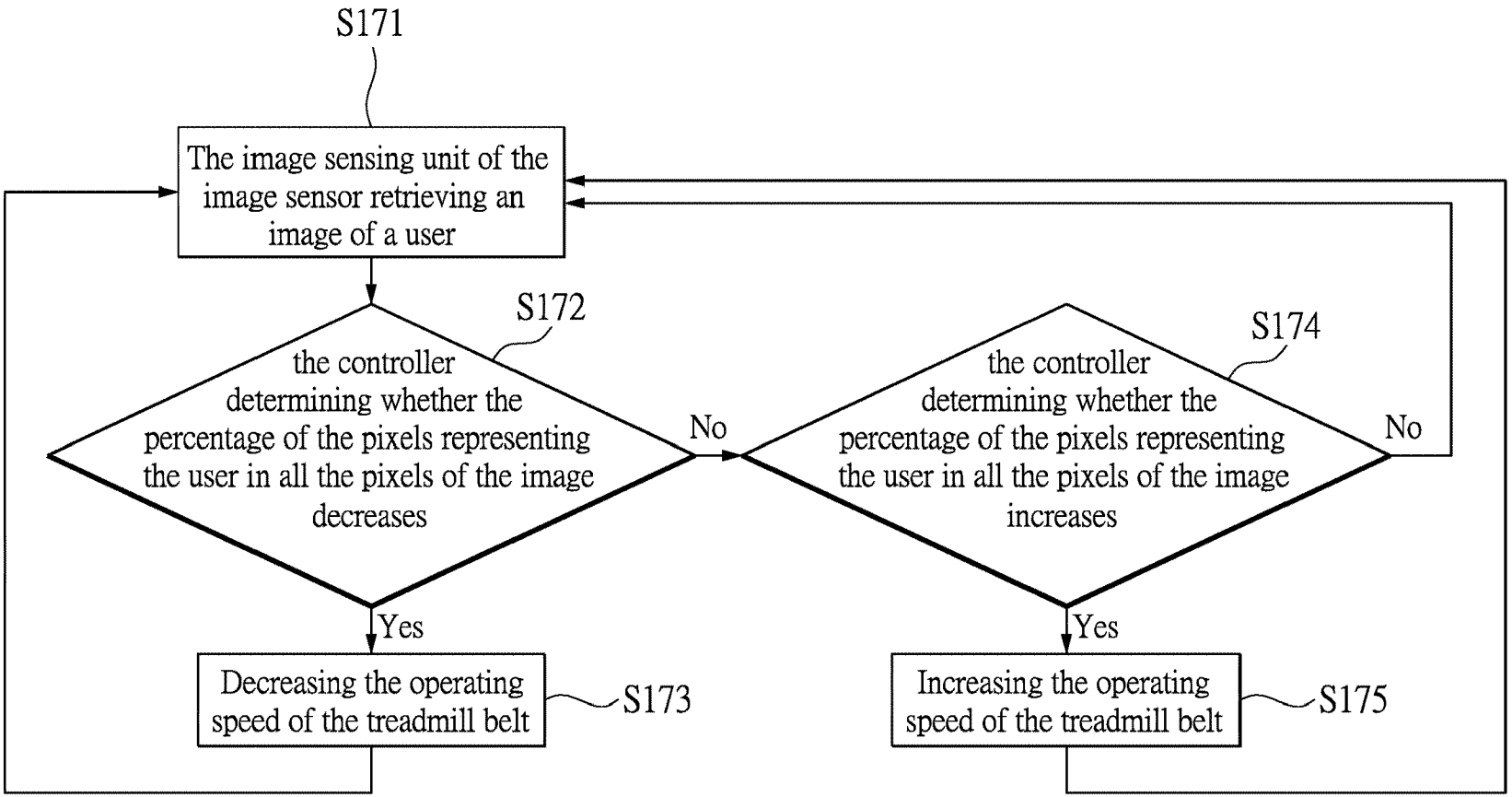
FIG. 17 is a flow chart illustrating a control method for controlling the treadmill belt of a treadmill according to yet another embodiment of the present disclosure.

With reference to FIGS. 14A, 14B and 17, the control method of FIG. 17 is applicable to the treadmill N of FIG. 14A.

In step S171, the image sensing unit 531 of the image sensor 53 retrieves an image of the object A. The image sensing unit 531 includes a plurality of pixels, which means that every image retrieved by the image sensing unit 531 is formed of a plurality of pixels as well.

Next, in step S172, the controller 70 determines whether the percentage of the pixels corresponding to the object A in the image retrieved by the image sensing unit 531 is decreasing. If so, the controller 70 performs step S173; if not, the controller 70 performs step S174. In step S173, since the controller 70 determines that in the image retrieved by the image sensing unit 531, the percentage of the pixels corresponding to the object A is decreasing, which means that the object A is getting further from the front end 201 of the treadmill N and is moving faster than the treadmill belt 20, the controller 70 decreases the operating speed of the treadmill belt 20 through a driving module (not shown) accordingly so that the object A can remain in the middle of the treadmill belt 20. Next, step S171 follows, and the control method begins anew.

In step S174, the controller 70 determines whether the percentage of the pixels corresponding to the object A in the image retrieved by the image sensing unit 531 is increasing. If so, the controller 70 performs step S175; if not, step S171 follows, and the control method begins anew. In step S175, since the controller 70 determines that in the image retrieved by the image sensing unit 531, the percentage of the pixels corresponding to the object A is increasing, which means that the object A is getting closer to the front end 201 of the treadmill N and is moving faster than the treadmill belt 20, the controller 70 decreases the operating speed of the treadmill belt 20 through a driving module (not shown) accordingly so that the object A can remain in the middle of the treadmill belt 20.

Figure 18:
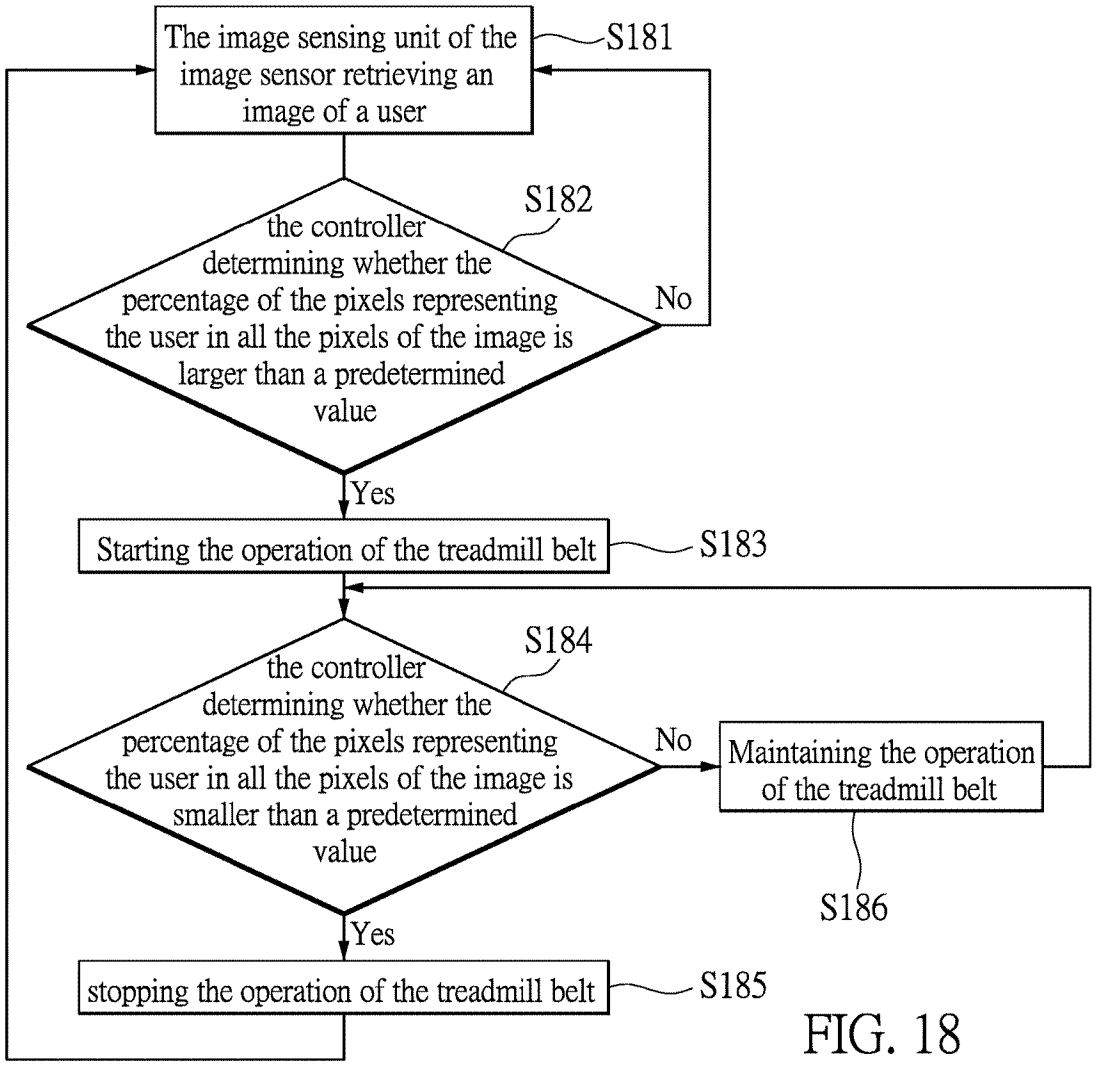
FIG. 18 is a flow chart illustrating a control method for controlling the treadmill belt of a treadmill according to another embodiment of the present disclosure.

Referring to FIGS. 14A, 14B and 18, the control method shown in FIG. 18 is applicable to the treadmill N of FIG. 14A. In the present embodiment, a predetermined value TH181 and a predetermined value TH183 can be set in the controller 70, in which the predetermined value TH181 and the predetermined value TH183 respectively correspond to a percentage of the pixels representing the object A.

In step S181, the image sensing unit 531 of the image sensor 53 retrieves an image of the object A. The image sensing unit 531 includes a plurality of pixels, which means that every image retrieved by the image sensing unit 531 is formed of a plurality of pixels.

Next, in step S182, the controller 70 determines whether the percentage of the pixels corresponding to the object A in the image retrieved by the image sensing unit 531 is greater than the predetermined value TH181. If so, the controller 70 performs step S183; if not, step S181 follows, and the control method begins anew. In step S183, since the controller 70 determines that in the image retrieved by the image sensing unit 531, the percentage of the pixels corresponding to the object A is greater than the predetermined value TH181, which means that the object A (user) is already standing at a predetermined position on the treadmill belt 20, the controller 70 starts the treadmill belt 20 accordingly.

Next, in step S184, the controller 70 determines whether the percentage of the pixels corresponding to the object A in the image retrieved by the image sensing unit 531 is smaller than the predetermined value TH183. If so, the controller 70 performs step S185; if not, the controller 70 performs step S186. In step S183, since the controller 70 determines that in the image retrieved by the image sensing unit 531, the percentage of the pixels corresponding to the object A is smaller than the predetermined value TH183, which means that the object A (the user) is already standing at a predetermined position on the treadmill belt 20, the controller 70 stops the treadmill belt 20 accordingly.

It should be noted that the predetermined value TH181 and the predetermined value TH183 described above are not to limit the scope of the present disclosure. A person skilled in the art can set the predetermined value TH181 and predetermined value TH183 according to actual needs.

Figure 19:
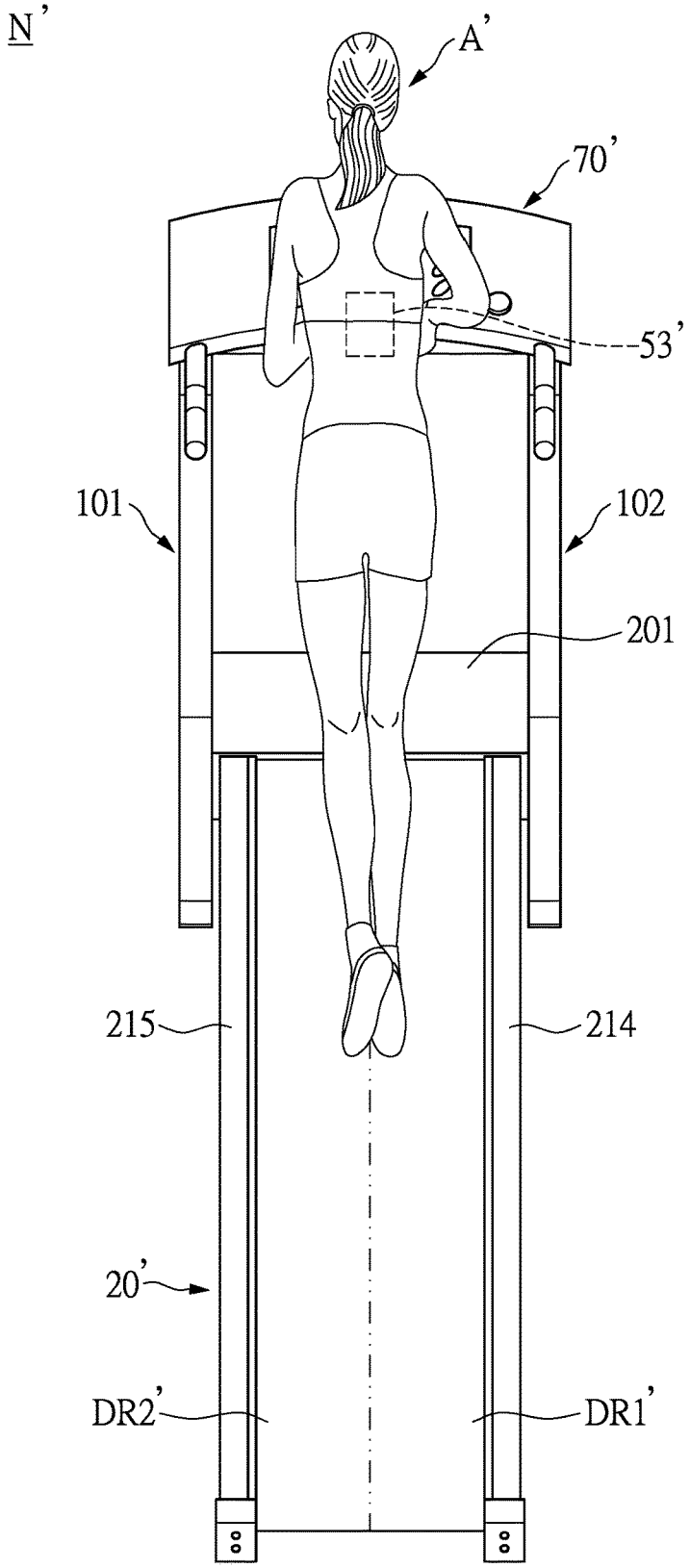
FIG. 19 is a schematic view illustrating the detection areas on the treadmill belt of a treadmill according to one embodiment of the present disclosure.
Figure 20A:
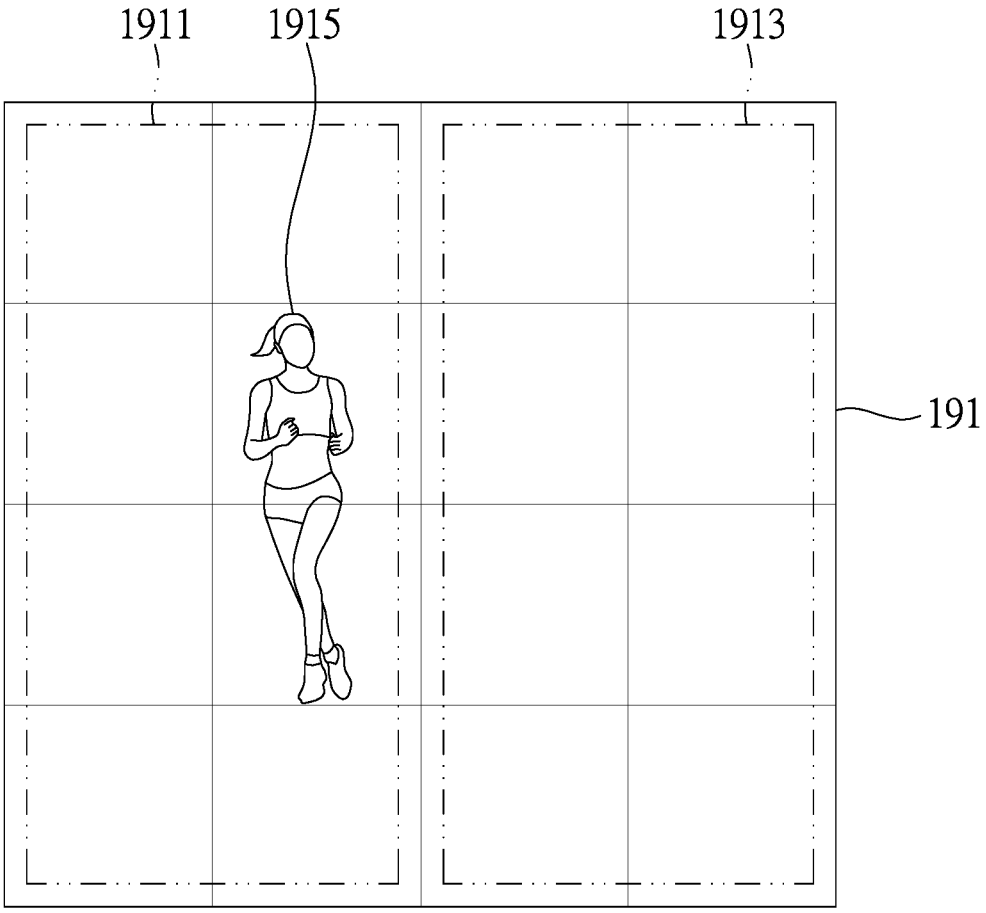
FIGS. 20A and 20B show the images retrieved by the image sensing units according to another embodiment of the present disclosure.
Figure 20B:
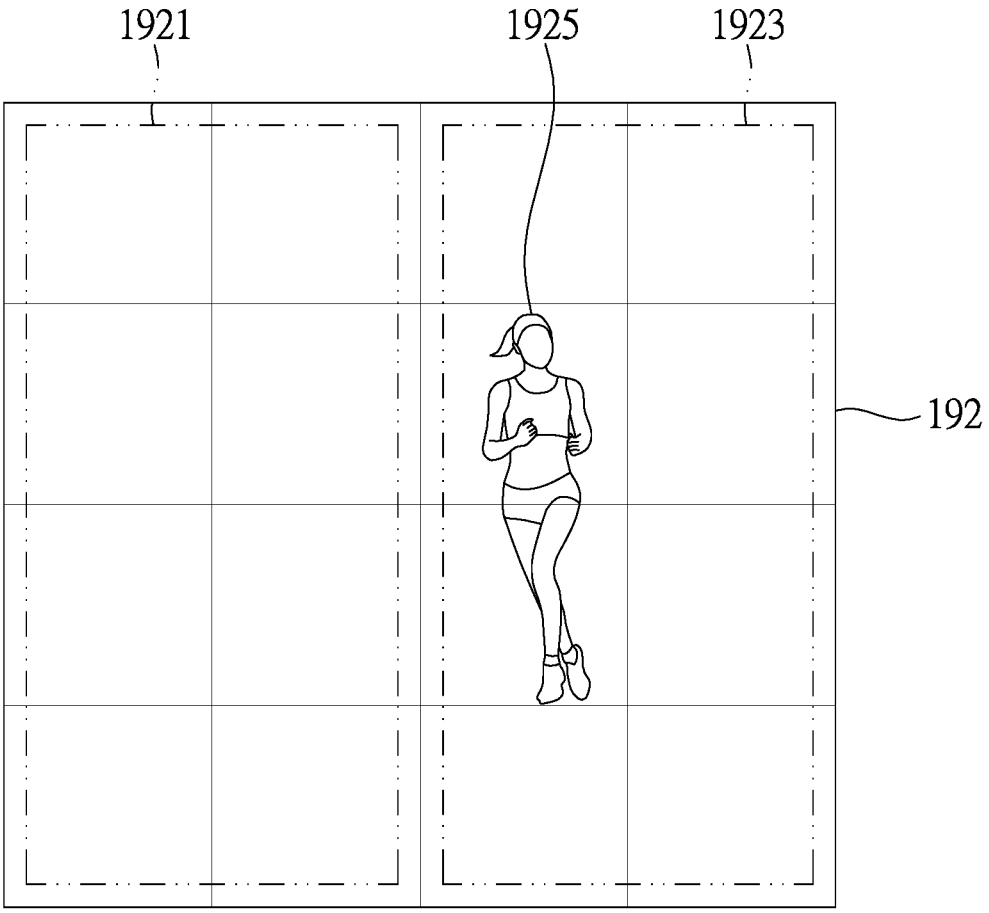

With reference to FIGS. 19, 20A and 20B, the treadmill N' provided by another embodiment of the present disclosure includes a treadmill belt 20', an image sensor 53', and a controller 70'. The controller 70' is coupled to the image sensor 53'. Specifically, the treadmill N' further includes a frame body 10 and a control panel 103 disposed on the frame body 10. The controller 70' can be disposed in the control panel 103. The frame body 10 includes a first support rail 101 and a second support rail 102 that are disposed on both sides of the treadmill belt 20' at an end thereof. The first support rail 101 and the second support rail 102 extend upwardly. The treadmill belt 20' includes a walking belt 202 and a support base 203 that supports the walking belt 202. The object A' refers to the user of the treadmill N'.

The difference between the treadmill N of FIG. 14 and the treadmill N' of the present embodiment is that the treadmill belt 20' of the treadmill N' is divided into a first detection area DR1' adjacent to a first side 214 and a second detection area DR2' adjacent to the second side 215. The image sensor 53' is located between the first side 214 and the second side 215. Referring to FIGS. 20A and 20B, the image 191 and 192 retrieved by the image sensing unit of the image sensor 53' is divided into a first image zone (1911 in FIGS. 20A and 1921 in FIG. 20B) close to the first side 214 of the treadmill belt 20' and a second image zone (1913 in FIGS. 20A and 1923 in FIG. 20B) close to the second side 215 of the treadmill belt 20'.

In the present embodiment, the controller 70' determines whether the object A' is in the first detection area DR1' or the second detection area DR2' according to the image retrieved by the image sensor 53' and adjusts the treadmill belt 20' accordingly.

With reference to FIG. 20A, in this embodiment, a predetermined value can be set (not shown) in the controller 70'. The predetermined value corresponds to a percentage of the pixels in the first image zone 1911 that represents the object A'. In the image 191, the figure 1915 corresponds to the object A'. When the percentage of the pixels in the figure 1915 is larger than the predetermined value, the controller 70' determines that the object A' is in the first detection area DR1' of the treadmill belt 20'.

Accordingly, the controller 70' adjusts the treadmill belt 20' through a driving module (not shown). For example, the controller 70' increases the slope of the treadmill belt 20' from the first side 214 such that the user shifts towards the second side 215 of the treadmill belt 20', whereby the user can remain in the middle of the treadmill belt 20'.

As shown in FIG. 20B, in this embodiment, a predetermined value can be set (not shown) in the controller 70'. The predetermined value corresponds to a percentage of the pixels in the second image zone 1923 that represents the object A'. In the image 192, the figure 1925 corresponds to the object A'. When the percentage of the pixels in the figure 1925 is larger than the predetermined value, the controller 70' determines that the object A' is in the second detection area DR2' of the treadmill belt 20'.

Accordingly, the controller 70' adjusts the treadmill belt 20' through a driving module (not shown). For example, the controller 70' increases the slope of the treadmill belt 20' from the second side 215 such that the user shifts towards the first side 214 of the treadmill belt 20', whereby the user can remain in the middle of the treadmill belt 20'.

Through the technical means provided by the present disclosure, the treadmill N' can adjust the treadmill belt 20' according to the position of the user. Therefore, when a user runs on a side of the treadmill belt 20' out of habit, the controller 70' will increase the slope of the side of the treadmill belt 20' where the user is running, thereby reducing the risk of a fall. Furthermore, through the constant adjustment of the treadmill belt 20', the user maintains running in the middle of the treadmill belt 20', which helps improve the running posture adopted by the user and reduce uneven pressure distribution applied on the treadmill N', by which treadmill M" can have a longer lifespan.

Figure 21:
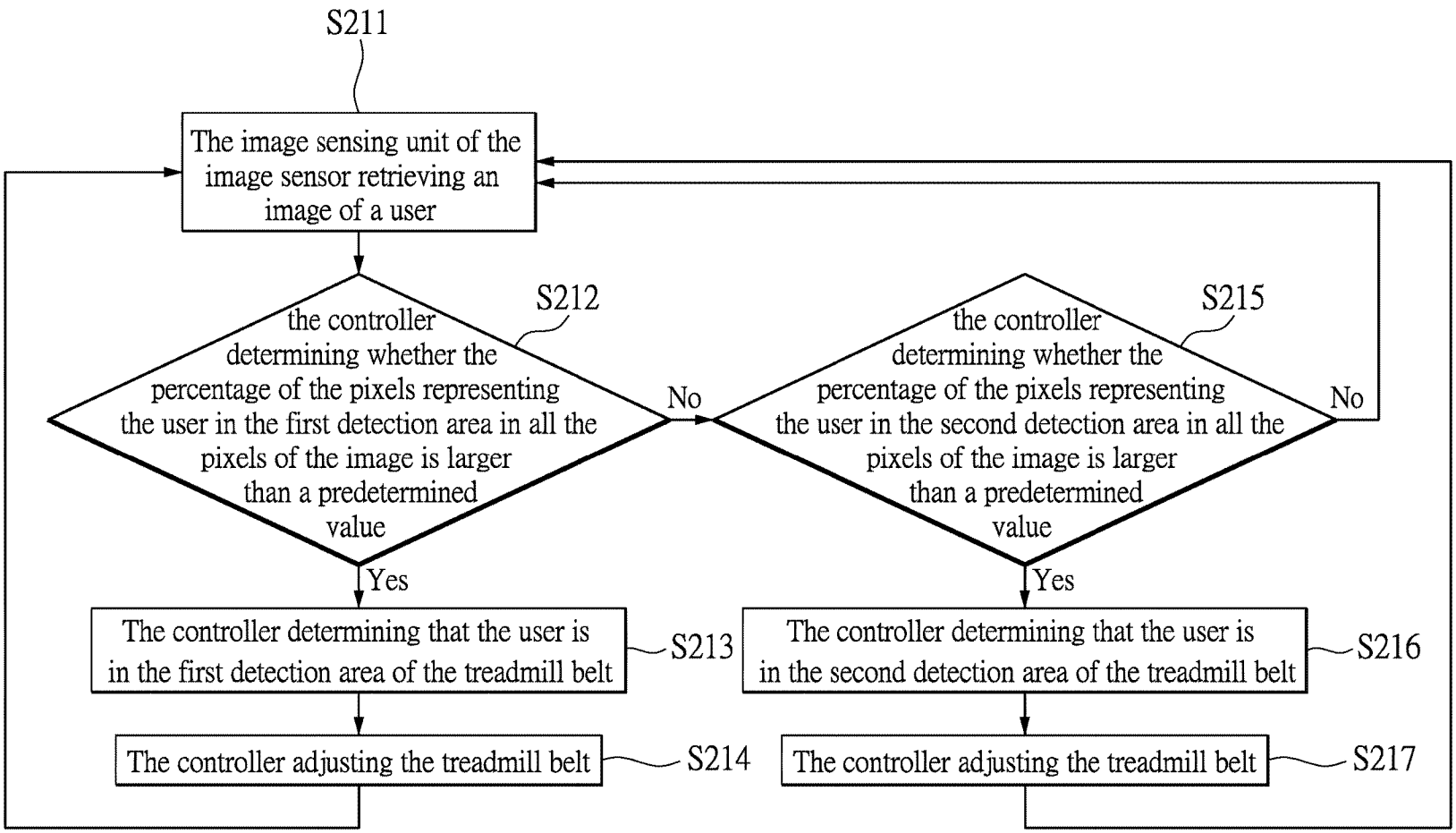
FIG. 21 is a flow chart illustrating the control method for controlling the treadmill belt of the treadmill according to another embodiment of the present disclosure.

The control method for controlling the treadmill belt of the treadmill N' will be explained below. With reference to FIGS. 19, 20A, 20B and 21, the control method shown in FIG. 21 is applicable to the treadmill N' of FIG. 19. In the present embodiment, a predetermined value TH211 and a predetermined value TH213 can be set in the controller 70', in which the predetermined value TH211 corresponds to a percentage of pixels in the first image zone that represent the object A', and the predetermined value TH213 corresponds to a percentage of pixels in the second image zone that represent the object A'.

In step S211, the image sensing unit of the image sensor 53' retrieves an image of the object A' (the user of the treadmill N'). Since the image sensing unit includes a plurality of pixels, every image retrieved by the image sensing unit is formed of a plurality of pixels.

In step S212, the controller 70' determines whether the percentage of the pixels in the first image zone that correspond to the object A' is greater than the predetermined value TH211. If so, the controller 70' performs step S213; if not, the controller 70' performs step S215. In step S213, since the percentage of the pixels in the first image zone that correspond to the object A' is greater than the predetermined value TH211, the controller 70' determines that the object A' is in the first detection area DR1' of the treadmill belt 20'. Next, in step S215, the controller 70' adjusts the treadmill belt 20' accordingly. For example, the controller 70' increases the slope of the treadmill belt 20' from the first side 214 such that the user shifts towards the second side 215. Next, the control method returns to step S211.

In step S215, the controller 70' determines whether the percentage of the pixels in the second image zone that correspond to the object A' is greater than the predetermined value TH213. If so, the controller 70' performs step S216; if not, step S211 follows, and the control method begins anew. In step S216, since the percentage of the pixels in the second image zone that correspond to the object A' is greater than the predetermined value TH213, the controller 70' determines that the object A' is in the second detection area DR2' of the treadmill belt 20'. Next, in step S217, the controller 70' adjusts the treadmill belt 20' accordingly. For example, the controller 70' increases the slope of the treadmill belt 20' from the second side 215 such that the user runs towards the first side 214. Next, the control method returns to step S211.

It should be noted that the predetermined value TH211 and the predetermined value TH213 described above are not to limit the scope of the present disclosure. A person skilled in the art can set the predetermined value TH211 and predetermined value TH213 according to actual needs.

Figure 22:
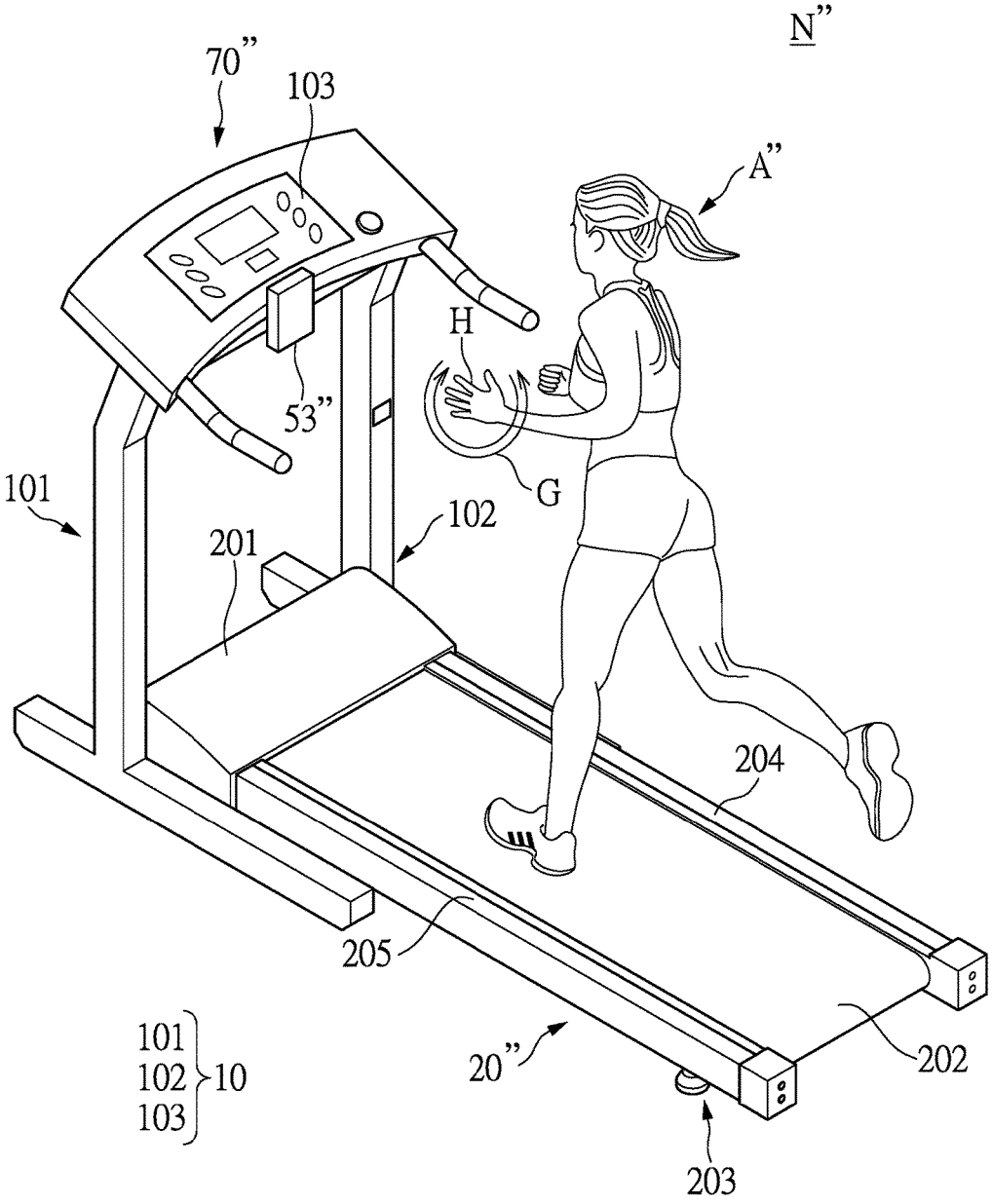
FIG. 22 is a schematic diagram illustrating the treadmill according to another embodiment of the present disclosure.
Figure 23:
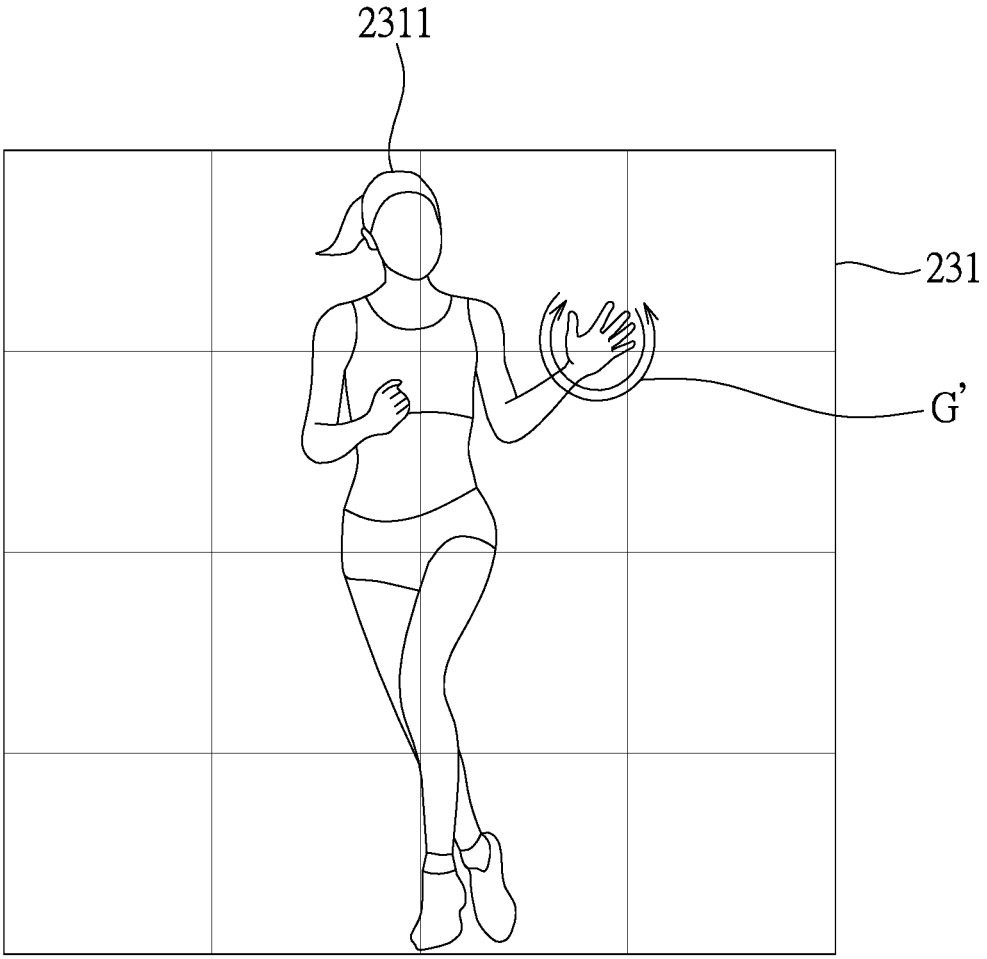
FIG. 23 is a schematic diagram illustrating an image retrieved by the image sensing unit according to another embodiment of the present disclosure.

Referring to FIG. 22 and FIG. 23, the treadmill N" provided by another embodiment of the present disclosure includes a treadmill belt 20", an image sensor 53", and a controller 70". The controller 70" is coupled to the image sensor 53". Specifically, the treadmill N" further includes a frame body 10 and a control panel 103 disposed on the frame body 10. The controller 70" can be disposed in the control panel 103. The frame body 10 includes a first support rail 101 and a second support rail 102 that are disposed on both sides of the treadmill belt 20" at an end thereof. The first support rail 101 and the second support rail 102 extend upwardly. The treadmill belt 20' includes a walking belt 202 and a support base 203 that supports the walking belt 202. The object A" refers to the user of the treadmill N". The treadmill N" of the present embodiment and the treadmill N and treadmill N' of the aforementioned embodiments share a similar structure, and the differences therebetween will be explained below.

The image sensor 53' in the present embodiment further includes an image processing unit (not shown). The image sensor 53" retrieves an image of the object A" (a user of the treadmill N") after every specific time interval. The controller 70" adjusts the treadmill belt 20" according to a characteristic property of the image, in which the characteristic property can be the percentage of the pixels corresponding to the object A" or the distribution manner thereof. In this embodiment, the characteristic property is the distribution manner of the pixels corresponding to the object A" in the image, the details of which are described below.

The image sensing unit of the image sensor 53" retrieves an image of the object A" which is then received by the image processing unit. The image processing unit calculates a dynamic gesture image corresponding to a gesture G made by the object A" with a hand H, and then outputs the dynamic gesture image to the controller 70". The controller 70" issues a control command according to the dynamic gesture image G' to adjust the treadmill belt 20".

With reference to FIG. 23, the image sensing unit of the image sensor 53" retrieves an image 231 of the object A". The figure 2311 in the image 231 corresponds to the object A", and the dynamic gesture image G' corresponds to the gesture G made by the object A" with the hand H. The dynamic gesture image G' can be a first image, a hands-spread-out image, a waving image, a hands-rotating-clockwise image, a hands-rotating-counterclockwise image, a hands-moving-up image, a hands-moving-down image, an arm-held-up image, an arm-laid-down image, an arm-held-out image, an arms-held-up image, an arms-laid-down image, and an arms-spread-out image. However, the present disclosure is not limited thereto.

After receiving the image 231 of the object A", the image processing unit of the image sensor 53" can calculate the dynamic gesture image G' that corresponds to the gesture G made by the object A" with the hand H. The image sensor 53" then outputs the dynamic gesture image G' to the controller 70". The controller 70" issues a control command according to the dynamic gesture image G' so as to perform certain operations on the treadmill belt 20" such as startup, shut down, or speed adjustment.

Figures 24, 25:
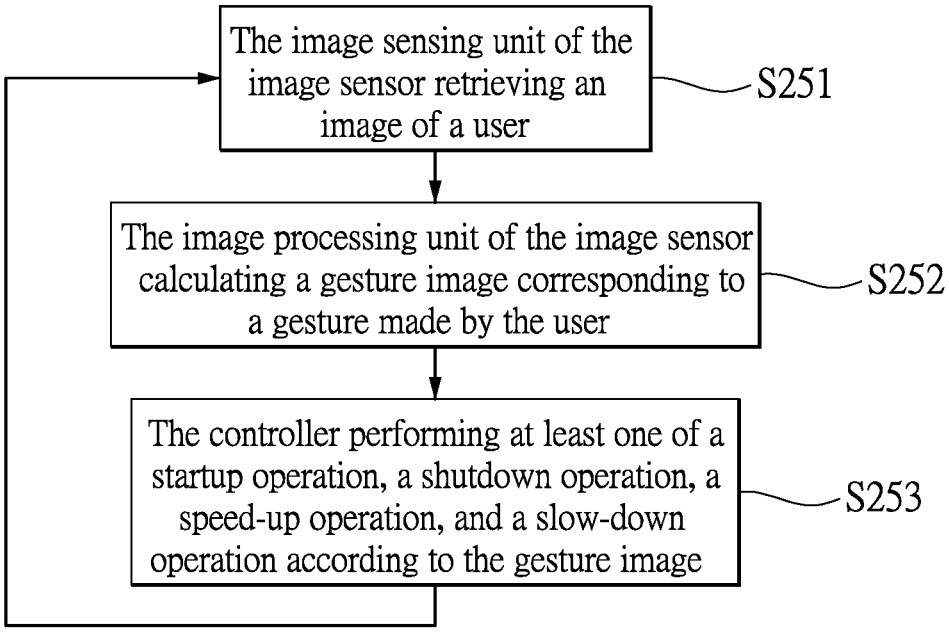
FIG. 24 is a table showing gestures and the commands corresponding thereto according to one embodiment of the present disclosure.
FIG. 25 is a flow chart illustrating the control method for controlling the treadmill belt of a treadmill according to another embodiment of the present disclosure.

Referring to FIG. 24, when the gesture G is "holding up both hands", the image processing unit of the image sensor 53" calculates the dynamic gesture image G' that corresponds to the gesture G and then the image sensor 53" outputs the dynamic gesture image G' to the controller 70". The controller 70" sends out a control command to start the treadmill belt 20". In this embodiment, the control command that corresponds to the gesture "waving hands" is to stop the treadmill belt 20"; the control command that corresponds to the gesture "rotating hands clockwise" is to increase the operating speed of the treadmill belt 20"; the control command corresponding to the gesture "rotating hands counterclockwise" is to decrease the operating speed of the treadmill belt 20"; the control command corresponding to the gesture "moving hands up" is to increase the slope of the treadmill belt 20"; the control command corresponding to the gesture "moving hands down" is to decrease the slope of the treadmill belt 20". Through the above technical means, the present disclosure realizes automatic adjustment of the treadmill belt 20" according to the gesture G made by the object A" with the hand H.

The gestures and commands listed in FIG. 24 are for exemplary purpose only. A person skilled in the art can design various gestures and the corresponding commands in accordance with actual needs. The techniques involved in the implementation of the image sensor 53" and the controller 70" are common knowledge in the art, and thus will not be further explained herein.

Through the technical means provided by the present disclosure, the treadmill N" can start, stop or adjust the treadmill belt 20" according to the gesture made by the user, whereby the user does not need to press any button on the treadmill N" to adjust the treadmill belt 20" during usage; instead, the treadmill performs various operations automatically.

The control method for controlling the treadmill belt of the treadmill N" will be explained below. With reference to FIGS. 22, 23 and 25, the control method shown in FIG. 25 is applicable to the treadmill N" of FIG. 22.

In step S251, the image sensing unit of the image sensor 53" retrieves an image 231 of the object A" (a user of the treadmill N"), in which the object A" is making a gesture G. Next, in step S252, the image processing unit of the image sensor 53" calculates the dynamic gesture image G' that corresponds to the gesture G according to the image 231. The image sensor 53" then outputs the dynamic gesture image G' to the controller 70". Next, in step S253, the controller 70" issues a control command to adjust the treadmill belt 20" according to the dynamic gesture image G'. For example, the controller 70" sends out a command that starts, stops or adjusts the treadmill belt 20". Through the above technical means, the present disclosure realizes automatic adjustment of the treadmill belt 20" according to the gesture G made by the object A" with the hand H.

In summary, the present disclosure provides a treadmill and a control method for controlling the treadmill belt thereof that retrieves images using a sensor. A controller adjusts the operating speed of the treadmill belt according to the length of the light pattern in the image. Therefore, the present disclosure can determine the physical condition or the running rate of the user according to the position of the user, and then increase or decrease the operating speed of the treadmill belt or stop the treadmill belt, which can prevent accidents that might happen when the user is too exhausted to keep running at a certain pace.

Furthermore, the treadmill and the control method for the treadmill belt thereof can compare the length of the first light pattern with that of the second light pattern using the controller, and the controller can adjust the treadmill belt according to the result of the comparison. Specifically, the treadmill of the present disclosure can adjust the slope of the treadmill according to whether the user is running on the left part or the right part of the treadmill belt so that the user can remain running in the middle of the treadmill belt, which improves the running posture and uneven pressure distribution applied to the treadmill. The lifespan of the treadmill can thereby be extended.

Moreover, the controller of the treadmill of the present disclosure can adjust the operating speed of the treadmill belt according to the percentage of the pixels corresponding to the user in the image retrieved by the image sensor. In addition, the controller can adjust the treadmill belt according to the dynamic gesture image derived from the image retrieved by the image sensor, thereby providing automatic adjustment of the treadmill belt without the user having to manually operate the treadmill.

The description illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A treadmill comprising:

a treadmill belt;

a first signal member disposed at position near a first side of the treadmill belt;

a first sensor that retrieves a first image, wherein the first image includes a first light pattern provided by the first signal member, the first light pattern extending from a first starting point of the first image; and a controller coupled to the first sensor, wherein the controller adjusts an operating speed of the treadmill belt in accordance with a characteristic property of the first light pattern.

2. The treadmill according to claim 1, wherein the characteristic property is a length, a position, or a quantity of the first light pattern.

3. The treadmill according to claim 1, wherein the controller calculates a step frequency according to the variation frequency of the length of the first light pattern.

4. The treadmill according to claim 1, wherein the treadmill belt includes a first sensing area adjacent to the first sensor and a second sensing area adjacent to the first sensing area, and the characteristic property is the length of the first light pattern, and the controller determines whether an object is in the first sensing area or the second sensing area of the treadmill belt according to the length of the first light pattern and adjusts the operating speed of the treadmill belt accordingly.

5. The treadmill according to claim 4, further comprising:

a second signal member disposed at a position near a second side of the treadmill belt and corresponding to the first signal member; and a second sensor retrieving a second image, wherein the second image includes a second light pattern provided by the second signal member, the second light pattern extending from a second starting point, wherein the controller receives the second image and calculates the second light pattern in the second image, and adjusts the operating speed of the treadmill belt in accordance with at least one of the length of the first light pattern and a length of the second light pattern.

6. A control method for controlling a treadmill belt of a treadmill, wherein the treadmill includes a treadmill belt, a first signal member being disposed at a position near a first side of the treadmill belt, the control method comprising:

a step A: retrieving a first image using a first sensor, wherein the first image includes a first light pattern provided by the first signal member, the first light pattern extending from a first starting point of the first image;

a step B: controlling an operating speed of the treadmill belt according to a length of the first light pattern using a controller.

* * * * *